US009007409B2

(12) United States Patent
Nakamura et al.

(10) Patent No.: US 9,007,409 B2
(45) Date of Patent: Apr. 14, 2015

(54) OPTICAL WRITING HEAD POSITIONING MECHANISM, PROCESS CARTRIDGE, AND IMAGE FORMING APPARATUS

(71) Applicants: Kenji Nakamura, Osaka (JP); Tamotsu Ikeda, Osaka (JP); Yasuhide Matsuno, Osaka (JP); Minoru Toyoda, Hyogo (JP); Masanari Fujita, Osaka (JP); Takahiro Yoshimi, Hyogo (JP)

(72) Inventors: Kenji Nakamura, Osaka (JP); Tamotsu Ikeda, Osaka (JP); Yasuhide Matsuno, Osaka (JP); Minoru Toyoda, Hyogo (JP); Masanari Fujita, Osaka (JP); Takahiro Yoshimi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/325,734

(22) Filed: Jul. 8, 2014

(65) Prior Publication Data

US 2015/0035928 A1 Feb. 5, 2015

(30) Foreign Application Priority Data

Jul. 31, 2013 (JP) ..... 2013-158765
Jan. 31, 2014 (JP) ..... 2014-016716

(51) Int. Cl.

| | |
|---|---|
| ***B41J 2/00*** | (2006.01) |
| ***B41J 2/435*** | (2006.01) |
| ***G03G 15/04*** | (2006.01) |
| ***G03G 21/18*** | (2006.01) |

(52) U.S. Cl.

CPC ..... *G03G 15/04* (2013.01); *G03G 21/18* (2013.01)

(58) Field of Classification Search

USPC ..... 347/123, 138, 141, 149, 152, 238, 242, 347/245, 257, 263; 399/118, 126, 159, 177

See application file for complete search history.

(56) References Cited

U.S. PATENT DOCUMENTS

| | | | | |
|---|---|---|---|---|
| 6,801,232 | B2 * | 10/2004 | Nagamine et al. | 347/149 |
| 2010/0054802 | A1 * | 3/2010 | Sakai et al. | 399/116 |
| 2012/0062686 | A1 * | 3/2012 | Suto et al. | 347/224 |

FOREIGN PATENT DOCUMENTS

| | | | | |
|---|---|---|---|---|
| JP | 53-104242 | | 9/1978 | |
| JP | 2002-361931 | | 12/2002 | |
| JP | 2005-181847 | | 7/2005 | |
| JP | 2007-076031 | | 3/2007 | |
| JP | 2010204362 | A * | 9/2010 | G03G 15/04 |
| JP | 2011-145684 | | 7/2011 | |

* cited by examiner

*Primary Examiner* — Hai C Pham

(74) *Attorney, Agent, or Firm* — Harness, Dickey & Pierce, P.L.C.

(57) ABSTRACT

An optical writing head positioning mechanism includes spacers provided between a latent image carrier for carrying an electrostatic latent image and an optical writing head for exposing the latent image carrier. The spacers each include at least one carrier contact surface that contacts the latent image carrier and at least one head contact surface that contacts the optical writing head to determine an interval between the latent image carrier and the optical writing head. The latent image carrier is in contact with a cleaning member that cleans a cleaning area on a surface of the latent image carrier. In at least one of the spacers, the at least one carrier contact surface includes plural carrier contact surfaces not disposed on edges of the cleaning area, and one of the edges of the cleaning area is located between two adjacent ones of the plural carrier contact surfaces.

12 Claims, 12 Drawing Sheets

OPTICAL WRITING HEAD POSITIONING MECHANISM, PROCESS CARTRIDGE, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2013-158765, filed on Jul. 31, 2013, in the Japan Patent Office, and Japanese Patent Application No. 2014-016716, filed on Jan. 31, 2014, in the Japan Patent Office, the entire disclosures of which are hereby incorporated by reference herein.

BACKGROUND

1. Technical Field

Embodiments of this disclosure relate to an optical writing head positioning mechanism that positions an optical writing head that writes an electrostatic latent image on a latent image carrier such as a photoconductor, a process cartridge equipped with the optical writing head positioning mechanism, and an image forming apparatus including the optical writing head positioning mechanism or the process cartridge.

2. Related Art

Some image forming apparatuses employ an optical writing head as an exposure device that forms an electrostatic latent image on a uniformly charged latent image carrier by directing the light of the image onto the latent image carrier (i.e., exposing the latent image carrier to light).

Such an image forming apparatus may further include an optical writing head positioning mechanism including multiple spacers provided between the latent image carrier and the optical writing head to determine the interval between the latent image carrier and the optical writing head.

For example, the image forming apparatuses may include two spacers disposed outside a recording medium, on which an image is to be formed, in a width direction perpendicular to a latent image carrier moving direction and in contact with end portions of the latent image carrier.

In the above-described image forming apparatus, however, positioning accuracy of the optical writing head relative to the latent image carrier may deteriorate over time.

Further, typical configurations for minimizing the deterioration of the positioning accuracy of the optical writing head relative to the latent image carrier make it difficult to reduce the size of the image forming apparatus or the process cartridge.

SUMMARY

In one embodiment of this disclosure, there is provided an improved optical writing head positioning mechanism that, in one example, includes spacers provided between a latent image carrier for carrying an electrostatic latent image and an optical writing head for exposing the latent image carrier to light. The spacers each include at least one carrier contact surface that contacts the latent image carrier and at least one head contact surface that contacts the optical writing head to determine an interval between the latent image carrier and the optical writing head. The latent image carrier is in contact with a cleaning member that cleans a cleaning area on a surface of the latent image carrier. In at least one of the spacers, the at least one carrier contact surface includes a plurality of carrier contact surfaces not disposed on edges of the cleaning area on the latent image carrier cleaned by the cleaning member, and one of the edges of the cleaning area is located between two adjacent carrier contact surfaces of the plurality of carrier contact surfaces.

In one embodiment of this disclosure, there is provided an improved process cartridge that, in one example, includes a latent image carrier and the above-described optical writing head positioning mechanism. The latent image carrier is exposed to light by an optical writing head to form an electrostatic latent image on the latent image carrier. The optical writing head positioning mechanism positions the optical writing head relative to the latent image carrier.

In one embodiment of this disclosure, there is provided an improved image forming apparatus that, in one example, includes the above-described optical writing head, the above-described latent image carrier, and the above-described optical writing head positioning mechanism that positions the optical writing head relative to the latent image carrier.

BRIEF DESCRIPTION OF THE DRAWINGS

A more complete appreciation of this disclosure and many of the advantages thereof are obtained as the same becomes better understood by reference to the following detailed description when considered in connection with the accompanying drawings, wherein.

DETAILED DESCRIPTION

Figure 1:
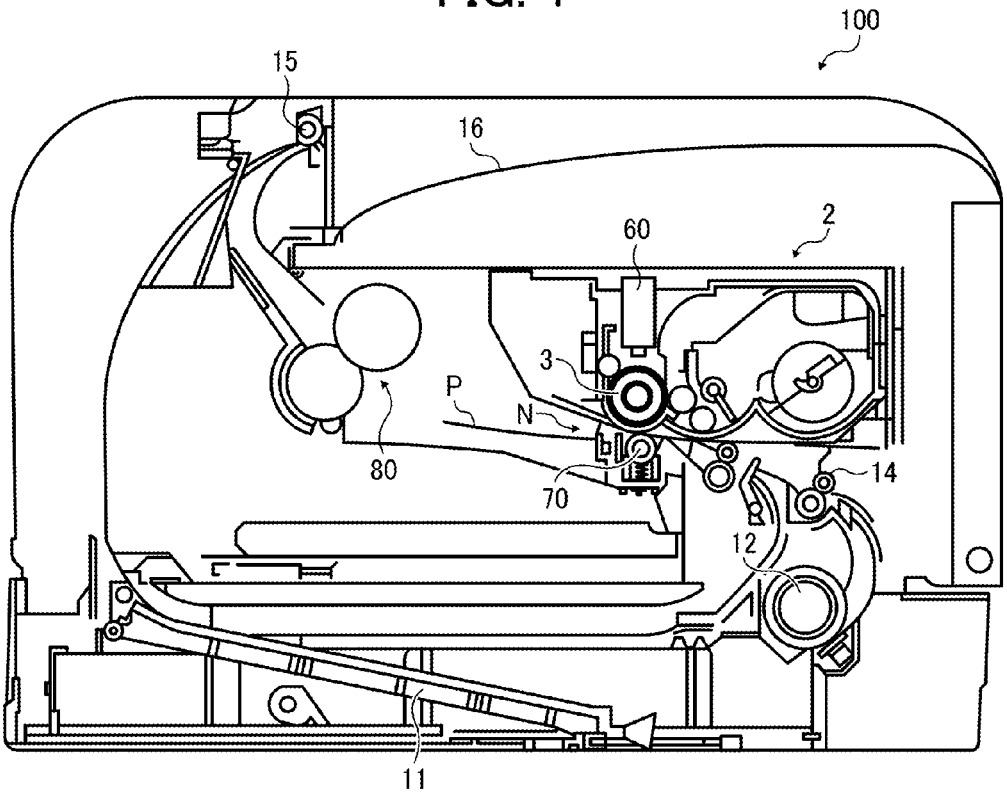
FIG. 1 is a schematic configuration diagram illustrating the configuration of a printer according to an embodiment of this disclosure.

In describing the embodiments illustrated in the drawings, specific terminology is adopted for the purpose of clarity. However, this disclosure is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, a printer as an electrophotographic monochrome image forming apparatus according to an embodiment of this disclosure (hereinafter referred to as the printer 100) will be described with reference to multiple embodiment examples.

The printer 100 according to the present embodiment includes an optical writing head positioning mechanism that positions an optical writing head employed as an exposure device for a drum-shaped photoconductor serving as a latent image carrier for carrying an electrostatic latent image. The optical writing head positioning mechanism includes a plurality of (two in this case) spacers to determine the interval between the photoconductor and the optical writing head. At least one of the spacers includes a plurality of photoconductor contact surfaces serving as carrier contact surfaces not disposed on edges of a cleaning area of a cleaning member. Further, one of the edges of the cleaning area is located between adjacent two of the photoconductor contact surfaces.

A basic overall configuration and operation of the printer 100 will now be described with reference to the drawings.

Figure 2:
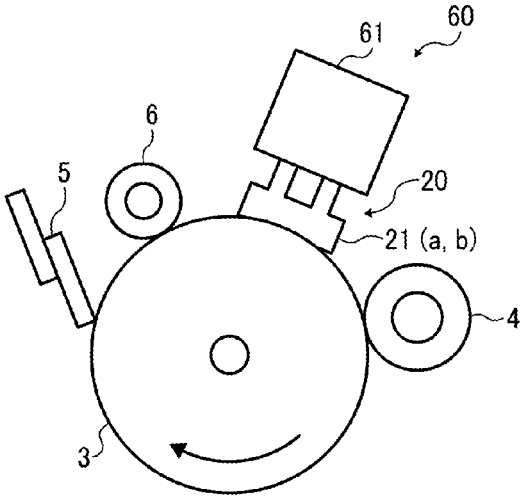
FIG. 2 is a schematic cross-sectional view of components of a process cartridge according to the embodiment.

FIG. 1 is a schematic configuration diagram illustrating the configuration of the printer 100 according to the present embodiment. FIG. 2 is a schematic cross-sectional view illustrating components of a process cartridge 2 of the printer 100.

As illustrated in FIG. 1, the printer 100 includes the process cartridge 2 disposed at substantially the center of the printer 100 and including a drum-shaped photoconductor 3 serving as a latent image carrier. An exposure device 60 for forming a latent image on the photoconductor 3 is disposed above the photoconductor 3 in the process cartridge 2. A transfer roller 70 is disposed under the process cartridge 2 to transfer a toner image formed on the drum-shaped photoconductor 3 in the process cartridge 2 onto a sheet P serving as a recording medium.

A sheet feeding cassette 11 and a sheet feed roller 12 are disposed in a lower part of the printer 100. The sheet feeding cassette 11 stores a stack of sheets P to which the toner image on the photoconductor 3 is to be transferred. The sheet feed roller 12 sequentially feeds the sheets P from the sheet feeding cassette 11 to a transfer area N between the photoconductor 3 and the transfer roller 70.

A fixing device 80 is disposed on the left side of the process cartridge 2 in FIG. 1 to heat-fix the toner image on the sheet P. A sheet discharge roller 15 is disposed above the fixing device 80 to discharge the sheet P subjected to heat-fixing onto a sheet discharge tray 16 forming an upper surface of the printer 100.

As illustrated in FIG. 2, the process cartridge 2 includes a charging roller 6, the exposure device 60 including an optical writing head 61, a development roller 4 forming a development device, and a cleaning blade 5 forming a photoconductor cleaning device, which are sequentially disposed around the photoconductor 3 in the rotation direction of the photoconductor 3 indicated by the arrow in FIG. 2 (hereinafter referred to as the photoconductor rotation direction) to collectively serve as an image forming unit. In the process cartridge 2, the photoconductor 3 and the members disposed around the photoconductor 3, i.e., the charging roller 6, the exposure device 60, the development roller 4, and the cleaning blade 5, are supported by a common support member to be integrated as a single unit integrally attachable to and detachable from the printer 100.

The process cartridge 2 further includes an optical writing head positioning mechanism 20 that positions the optical writing head 61 of the exposure device 60 relative to the photoconductor 3.

As described in detail later, the optical writing head positioning mechanism 20 includes spacers 21*a* and 21*b* that contact the photoconductor 3 and the optical writing head 61 to determine the interval between the photoconductor 3 and the optical writing head 61. That is, the spacers 21*a* and 21*b* provided in the optical writing head positioning mechanism 20 are disposed between the photoconductor 3 and the optical writing head 61 to function as regulation members for regulating the distance between the photoconductor 3 and the optical writing head 61 and determine the interval between the photoconductor 3 and the optical writing head 61.

Preferably, the optical writing head 61 of the present embodiment is comprised of light emitting elements such as light emitting diodes (LEDs) or organic electroluminescence (EL) elements. With such light emitting elements, the exposure device 60 has a compact configuration, contributing to a reduction in size of the printer 100 and forming a favorable electrostatic latent image on the photoconductor 3.

In the process cartridge 2 of the present embodiment, a surface of the photoconductor 3 is first uniformly charged by the charging roller 6 with the rotation of the photoconductor 3. Then, based on image data, a beam is emitted from the exposure device 60 and directed onto the photoconductor 3 to form an electrostatic latent image on the photoconductor 3. Thereafter, the development roller 4 causes toner to adhere to the electrostatic latent image to render the electrostatic latent image visible, thereby forming a toner image on the photoconductor 3. Meanwhile, the sheet feed roller 12 separates a sheet P serving as a recording medium from the other sheets P in the sheet feeding cassette 11 and feeds the sheet P to registration rollers 14 in FIG. 1. The sheet P is hit against and stopped by the registration rollers 14.

Then, the registration rollers 14 transport the stopped sheet P to the transfer area N, at which the photoconductor 3 and the transfer roller 70 face each other, such that the toner image formed in the process cartridge 2 and the sheet P arrive at the transfer area N at the same time. In the transfer area N, a high voltage is applied to the transfer roller 70 to provide a potential difference between the photoconductor 3 and the transfer roller 70, thereby transferring the toner image formed on the photoconductor 3 onto the sheet P. The sheet P bearing the toner image transferred thereto is sent to the fixing device 80 to heat-fix the toner image on the sheet P. Thereafter, the sheet P is discharged onto the sheet discharge tray 16 forming the upper surface of the printer 100 by the sheet discharge roller 15. After the transfer of the toner image, residual toner remaining on the surface of the photoconductor 3 is cleaned off by the cleaning blade 5 to prepare for the next image formation.

Before describing the optical writing head positioning mechanism 20 included in the process cartridge 2 of the printer 100 according to the present embodiment in detail with reference to embodiment examples, an optical writing head positioning mechanism according to a related-art example will be described to further an understanding of this disclosure.

In the following description of the optical writing head positioning mechanisms 20 according to the embodiment examples and the optical writing head positioning mechanism according to the related-art example, like reference numerals designate identical components or components having similar functions, unless there is a need to distinguish the components.

A related-art example of the configuration of the optical writing head positioning mechanism 20 included in the process cartridge 2 will now be described with reference to drawings.

Figure 3:
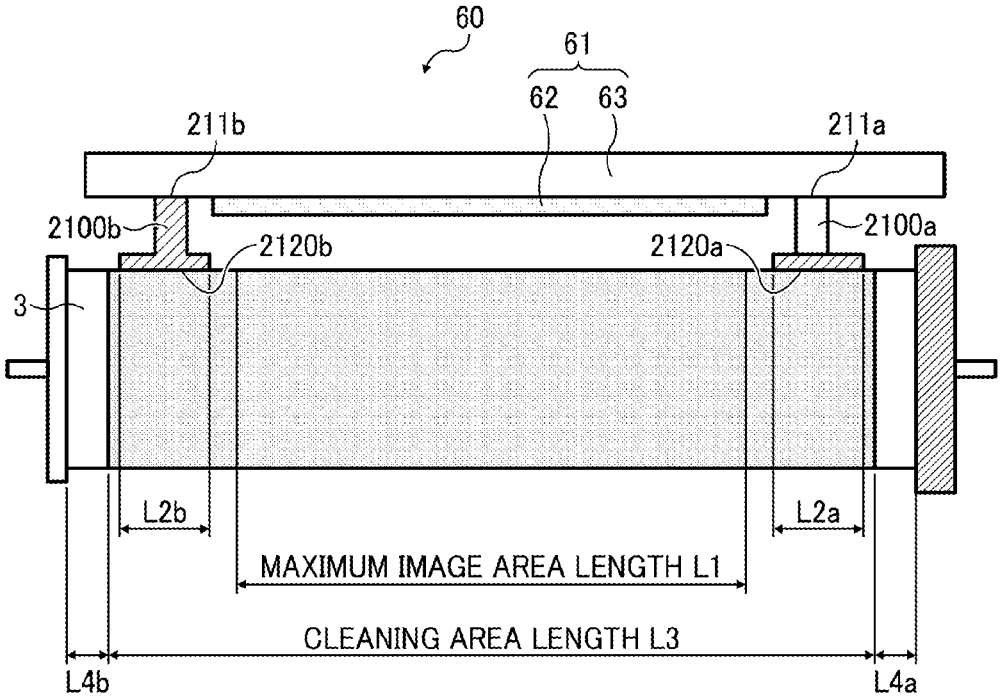
FIG. 3 RELATED ART
FIG. 3 is a diagram illustrating the disposition and size in a photoconductor axial direction of spacers according to a related-art example.

FIG. 3 is a diagram illustrating the disposition and size of spacers 2100*a* and 2100*b* according to the related-art example in the axial direction of the photoconductor 3 (hereinafter referred to as the photoconductor axial direction). For clarity of shape, FIG. 3 illustrates a cross-sectional view of the spacers 2100*a* and 2100*b* taken along a plane passing through the axis of the photoconductor 3 and a side view of the optical writing head 61 and respective areas of the photoconductor 3 and the spacers 2100*a* and 2100*b*.

Figure 4A:
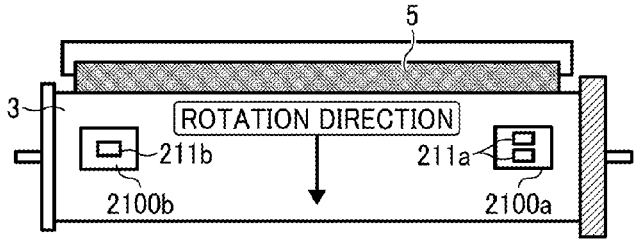
FIG. 4A RELATED ART
FIGS. 4A to 4E are diagrams illustrating an issue of the spacers according to the related-art example.
Figure 4B:
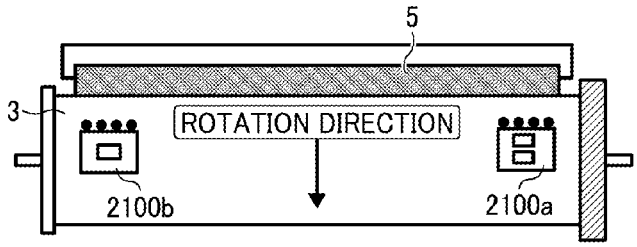
FIG. 4B RELATED ART
Figure 4C:
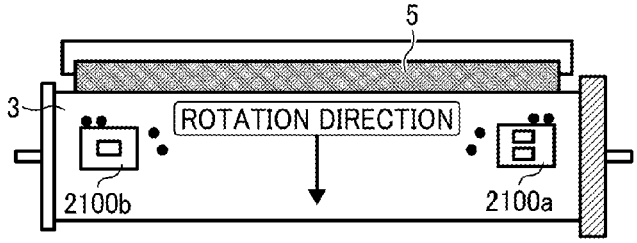
FIG. 4C RELATED ART
Figure 4D:
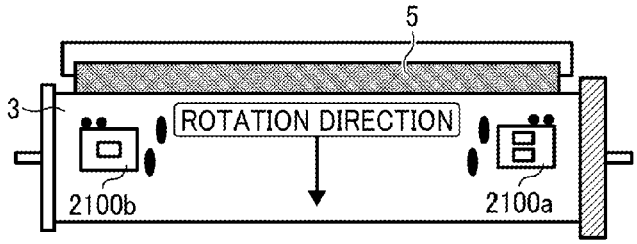
FIG. 4D RELATED ART
Figure 4E:
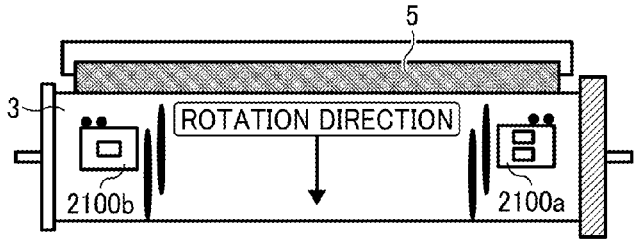
FIG. 4E RELATED ART

FIGS. 4A to 4E are diagrams illustrating issues of the spacers 2100*a* and 2100*b* according to the related-art example. FIG. 4A is a diagram illustrating a state before cleaning residues having slipped through the cleaning blade 5 accumulate on the spacers 2100*a* and 2100*b*. FIG. 4B is a diagram illustrating the cleaning residues having slipped through the cleaning blade 5 and accumulating on the spacers 2100*a* and 2100*b*. FIG. 4C is a diagram illustrating the accumulated cleaning residues falling into a maximum image area from the spacers 2100*a* and 2100*b*. FIG. 4D is a diagram illustrating the fallen cleaning residues sticking to the photoconductor 3. FIG. 4E is a diagram illustrating the stuck deposits growing from where the cleaning residues fall and stick to the photoconductor 3.

As illustrated in FIG. 3, the optical writing head 61 of the exposure device 60 is comprised of a lens array 62 and a head frame 63 for holding the lens array 62. Further, the spacers 2100*a* and 2100*b* of the optical writing head positioning mechanism 20 for positioning the optical writing heat 61 are disposed between the photoconductor 3 and the optical writing head 61 at two locations in the photoconductor axial direction.

Further, as illustrated in FIG. 4A, for example, the spacer 2100*a* includes two head contact surfaces 211*a* in contact with the optical writing head 61, and the spacer 2100*b* includes one head contact surface 211*b* in contact with the optical writing head 61. The spacers 2100*a* and 2100*b* further include first photoconductor contact surfaces 2120*a* and 2120*b*, respectively, which serve as carrier contact surfaces that contact the photoconductor 3.

The head contact surfaces 211*a* of the spacer 2100*a* and the head contact surface 211*b* of the spacer 2100*b* are disposed to be in contact with portions of the head frame 63 lying outside the lens array 62 in the photoconductor axial direction.

In the process cartridge 2 or the printer 100 equipped with the above-described optical writing head positioning mechanism 20, the positioning accuracy of the optical writing head 61 relative to the photoconductor 3 may deteriorate over time. Further, typical configurations for minimizing the deterioration of the positioning accuracy of the optical writing head 61 relative to the photoconductor 3 make it difficult to reduce the size of the process cartridge 2 or the printer 100.

The above issues are caused by degraded positioning accuracy of the spacers 2100*a* and 2100*b* relative to the photoconductor 3 due to the presence of residual toner, such as post-transfer residual toner, stuck between the photoconductor 3 and the first photoconductor contact surfaces 2120*a* and 2120*b* of the spacers 2100*a* and 2100*b*.

Reasons for the above issues will now be described in detail.

Similarly to the process cartridge 2 according to the embodiment described above with reference to FIG. 2, the process cartridge 2 according to the related-art example also includes the cleaning blade 5 serving as the cleaning member for scraping off and removing the post-transfer residual toner and so forth remaining on the photoconductor 3 after the transfer process. In the configuration that thus removes the post-transfer residual toner and so forth, the opposed ends of the cleaning blade 5 in the photoconductor axial direction are provided with sealing members for filling gaps between the cleaning blade 5 and a casing of the photoconductor cleaning device. In some cases, post-transfer residual toner and so forth having failed to be removed from the gaps remain on the photoconductor 3 as streaks of residual toner. That is, streaks of residual toner sometimes remain on the photoconductor 3 near the edges (i.e., end portions) of the cleaning area of the cleaning blade 5 having a length (i.e., width) L3 (hereinafter also referred to as the cleaning area ends).

The amount per unit width of the streaks of residual toner in the areas near the cleaning area ends is greater than the amount per unit width of residual toner, i.e., cleaning residues, having slipped through the cleaning blade 5 in the other areas of the photoconductor 3. When the residual toner reaches the spacers 2100*a* and 2100*b*, the development roller 4, or the charging roller 6, or returns to the cleaning blade 5, therefore, the residual toner is more likely to stick to the photoconductor 3 in the areas near the cleaning area ends than in the other areas.

If the residual toner thus sticks to the photoconductor 3, the positioning accuracy of the spacers 2100*a* and 2100*b* of the optical writing head positioning mechanism 20 relative to the photoconductor 3 deteriorates, also causing deterioration of the positioning accuracy of the optical writing head 61 relative to the photoconductor 3. That is, the positioning accuracy of the optical writing head 61 relative to the photoconductor 3 may deteriorate over time.

Since the optical writing head 61 has a shallow depth of focus of approximately 100 μm, it is necessary to highly accurately determine the distance between the optical writing head 61 and the photoconductor 3. Further, since the spacers 2100*a* and 2100*b* contact the photoconductor 3, it is necessary to dispose the spacers 2100*a* and 2100*b* to keep foreign substances such as the residual toner from getting between the first photoconductor contact surfaces 2120*a* and 2120*b* of the spacers 2100*a* and 2100*b* and the photoconductor 3.

In the spacers 2100*a* and 2100*b* of the related-art example, therefore, it is necessary to prevent the streaks of residual toner from forming near the ends of the cleaning area of the cleaning blade 5 to prevent foreign substances such as the residual toner from entering between the first photoconductor contact surfaces 2120*a* and 2120*b* of the spacers 2100*a* and 2100*b* and the photoconductor 3. It is therefore desirable to dispose each of the spacers 2100*a* and 2100*b* in an area inside or outside the cleaning area, in which the toner does not adhere to the photoconductor 3.

FIG. 3 illustrates a case in which the spacers 2100*a* and 2100*b* are disposed inside the cleaning area. Herein, L3 represents the length (i.e., width) of the cleaning area, and L1 represents the length (i.e., width) of the maximum image area in which the image is formed. Further, L2a represents the length of the first photoconductor contact surface 2120*a* of the spacer 2100*a*, and L2b represents the length of the first photoconductor contact surface 2120*b* of the spacer 2100*b*. In this case, the length L3 of the cleaning area needs to satisfy at least L3>L1+L2a+L2b, which increases the length in the photoconductor axial direction (hereinafter referred to as the axial length) of the cleaning blade 5 serving as the cleaning member.

Conversely, if the spacers 2100*a* and 2100*b* are disposed outside the cleaning area, lengths L4a and L4b of portions of the photoconductor 3 other than the cleaning area need to be greater than the lengths L2a and L2b, respectively, which increases the entire axial length of the photoconductor 3.

In the related-art example, it is thus necessary to dispose the spacers 2100*a* and 2100*b* inside or outside the cleaning area ends to prevent the streaks of residual toner from forming near the cleaning area ends, which increases the entire length of the photoconductor 3 or the cleaning blade 5.

The above-described configurations for minimizing the deterioration of the positioning accuracy of the optical writing head 61 relative to the photoconductor 3, therefore, make it difficult to reduce the size of the process cartridge 2 or the printer 100.

It is conceivable to reduce the lengths (i.e., widths) L2a and L2b in the photoconductor axial direction of the spacers 2100*a* and 2100*b* to prevent the increase of the entire length of the photoconductor 3 or the cleaning blade 5. However, the spacers 2100*a* and 2100*b* need to have a predetermined length for the following reasons.

To determine the interval between the photoconductor 3 and the optical writing head 61, it is necessary to place a predetermined load (i.e., biasing force) on the photoconductor 3 from the optical writing head 61. If the lengths L2a and L2b in the photoconductor axial direction of the spacers 2100*a* and 2100*b* are excessively reduced, however, pressure generated between the photoconductor 3 and the first photoconductor contact surfaces 2120*a* and 2120*b* of the spacers 2100*a* and 2100*b* is excessively increased, promoting abrasion of the photoconductor 3 and the spacers 2100*a* and 2100*b*.

Further, the spacers 2100*a* and 2100*b* need to have a predetermined axial length so as not to topple over in the photoconductor axial direction, depending on the configurations of contact areas of the spacers 2100*a* and 2100*b*.

JP-2007-076031-A also describes a cleaning member (i.e., a cleaning brush) disposed to contact a latent image carrier (i.e., a photoconductor drum) to clean off post-transfer residual toner and so forth remaining on the latent image carrier. The publication further describes spacers each having a predetermined length in a direction perpendicular to a latent image carrier moving direction. In each of the spacers, a side surface forming a side tilted relative to the direction perpendicular to the latent image carrier moving direction is provided on the upstream side in the latent image carrier moving direction of a contact surface of the spacer in contact with the latent image carrier. The publication indicates that, since each of the spacers has the side surface forming the side tilted relative to the direction perpendicular to the latent image carrier moving direction, it is possible to move the residual toner and so forth along the tilt, thereby minimizing accumulation of the residual toner and so forth on the upstream side of the spacers in the latent image carrier moving direction.

In each of the spacers described in the publication, however, the tilted side is formed on the upstream end portion of the spacer in the latent image carrier moving direction. On the upstream side of the spacer, therefore, the length (i.e., width) of the spacer in the direction perpendicular to the latent image carrier moving direction is increased from upstream to downstream. Therefore, it is difficult to keep the tilted side of the upstream end portion of the spacer in airtight contact with the latent image carrier such as the photoconductor drum to fit the curvature of the latent image carrier due to abrasion over time and processing errors of the latent image carrier and the spacer. As a result, residual toner and so forth are likely to enter between the latent image carrier and the spacer.

Particularly in the cleaning area ends in which the above-described streaks of residual toner form, the amount per unit width of cleaning residues is greater than in the other areas. Thus, the residual toner and so forth are likely to enter between the latent image carrier and the spacers, even if the spacers have the above-described tilt. The residual toner and so forth having thus entered between the latent image carrier and the spacers may stick to the latent image carrier owing to the frictional heat generated between the latent image carrier and the spacers and the pressure exerted by the spacers, degrading the positioning accuracy of the optical writing head relative to the latent image carrier and thereby causing an image failure.

To prevent such a failure, it is necessary to dispose the spacers inside or outside the edges of the cleaning area to prevent the streaks of residual toner from forming on and sticking to the latent image carrier, as in the foregoing related-art example.

Even with the configuration in which the spacers each have the side surface forming the tilted side on the upstream side of the spacer in the latent image carrier moving direction, therefore, it is difficult to reduce the size of the process cartridge or the image forming apparatus, as in the foregoing related-art example.

JP-4073234-B1 (JP-2002-361931-A) describes spacers having contact surfaces in contact with the latent image carrier and configured to make it difficult for residual toner and so forth to enter between the latent image carrier and the contact surfaces of the spacers from the upstream side in the latent image carrier moving direction. Although the publication does not mention a cleaning member, if the cleaning member is provided for the latent image carrier, and if the spacers are disposed on the cleaning area ends at which the streaks of residual toner form, however, the residual toner and so forth may enter between the latent image carrier and the spacers.

The publication also describes a configuration partially similar to the configuration of the later-described spacers 21*a* and 21*b* of the present embodiment, in which a groove extending along the latent image carrier moving direction is provided at substantially the center in the width direction of the contact surface of each of the spacers in contact with the latent image carrier. The publication, however, neither describes nor suggests a configuration concerning the positions in the width direction of the edges of the cleaning area and the contact surfaces of the spacers.

Even with reference to this publication, therefore, the spacers may be disposed at positions other than the edges of the cleaning area, thereby increasing the length in the width direction of the latent image carrier or the cleaning member and thus making it difficult to reduce the size of the process cartridge or the image forming apparatus, as described above.

Further, as illustrated in FIG. 4A, the spacers 2100*a* and 2100*b* of the related-art example are disposed inside the cleaning area of the cleaning blade 5, i.e., inside the cleaning area ends, in the photoconductor axial direction.

The cleaning blade 5 is capable of cleaning off the post-transfer residual toner and so forth remaining on the photoconductor 3 after the transfer process. The cleaning blade 5, however, fails to clean off substances separated from the toner and having a particle diameter of approximately a few nanometers, such as silica. Thus, some of the separated substances slip through the cleaning blade 5 and form cleaning residues. With the rotation of the photoconductor 3, the cleaning residues accumulate on the upstream side of the spacers 2100*a* and 2100*b* in the photoconductor rotation direction, as illustrated in FIG. 4B.

Thereafter, the accumulated cleaning residues fall into the maximum image area at a given time owing to vibration or the like, as illustrated in FIG. 4C. The cleaning residues within the maximum image area are then pressed against the photoconductor 3 by the development roller 4 and the cleaning blade 5 in FIG. 2, thereby sticking to the photoconductor 3, as illustrated in FIG. 4D.

Then, as illustrated in FIG. 4E, further residual toner and so forth adhere onto the stuck cleaning residues. Thereby, so-called fish marks formed of the stuck deposits grow from the stuck cleaning residues, eventually causing an image failure.

With reference to drawings, description will be given of a first embodiment example of the configuration of the optical writing head positioning mechanism 20 included in the process cartridge 2 of the printer 100 according to the present embodiment.

Figure 5:
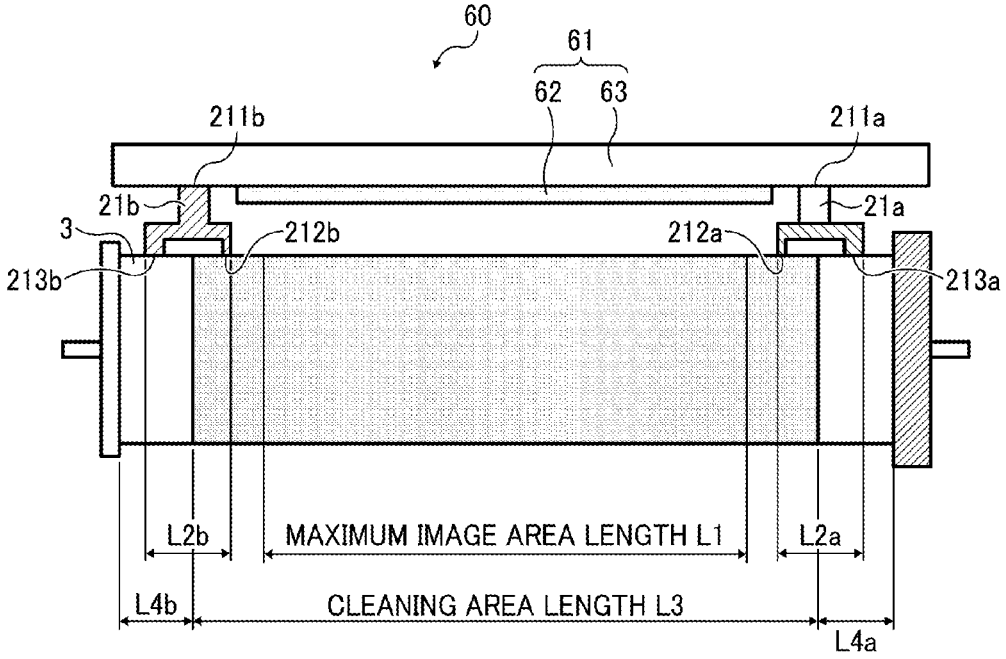
FIG. 5 is a diagram illustrating the disposition and size in the photoconductor axial direction of spacers according to a first embodiment example.
Figure 6A:
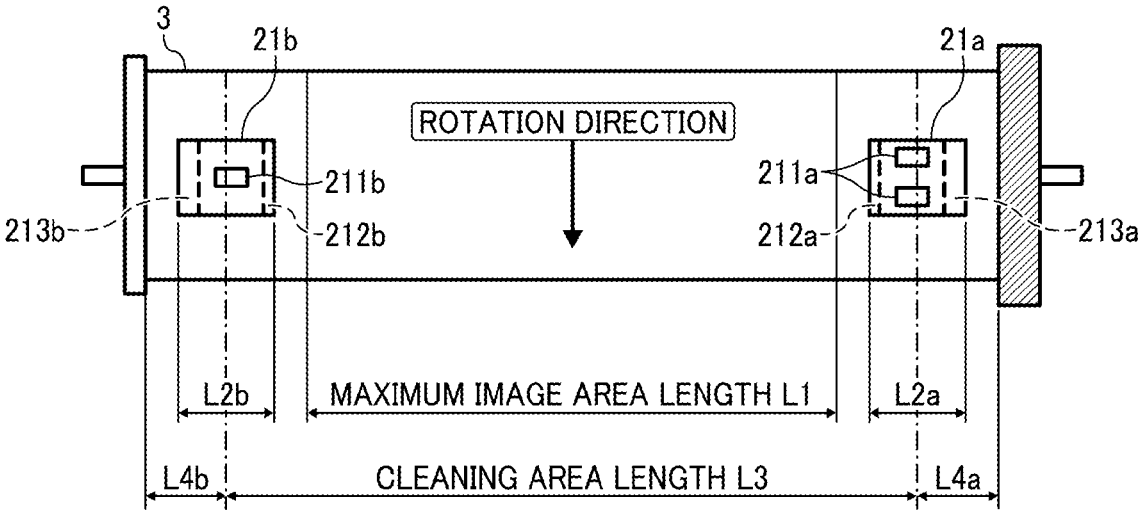
FIGS. 6A and 6B are diagrams illustrating the relationship between first photoconductor contact surfaces and second photoconductor contact surfaces of the spacers according to the first embodiment example and end portions of a cleaning area of a cleaning blade.
Figure 6B:
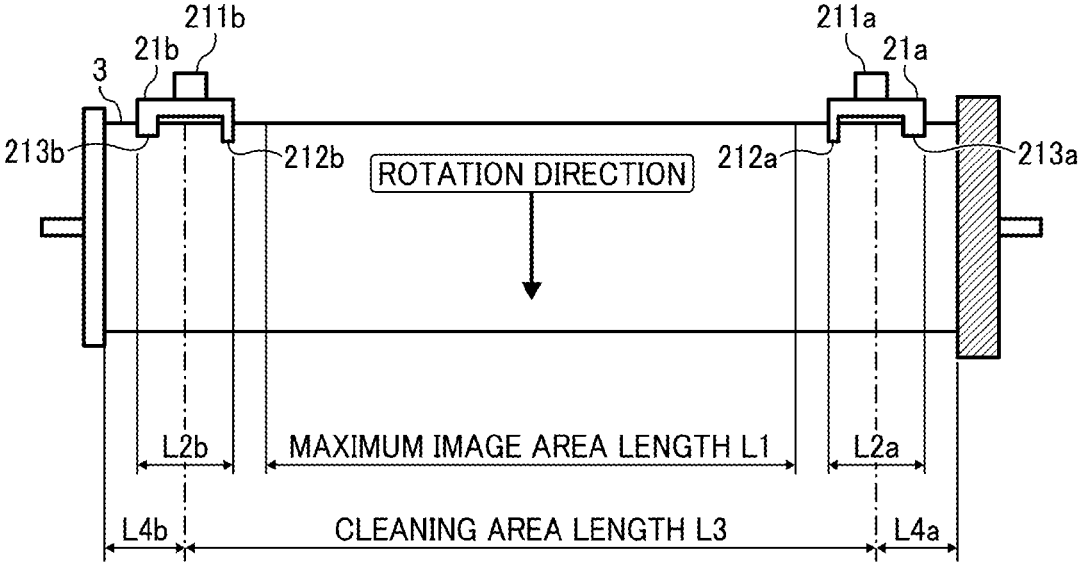

FIG. 5 is a diagram illustrating the disposition and size in the photoconductor axial direction of the spacers 21*a* and 21*b* according to the present embodiment example. FIGS. 6A and 6B are diagrams illustrating the relationship between first photoconductor contact surfaces 212*a* and 212*b* and second photoconductor contact surfaces 213*a* and 213*b* of the spacers 21*a* and 21*b* according to the present embodiment example and the end portions of the cleaning area of the cleaning blade 5 having the length L3. FIG. 6A is a top view of the spacers 21*a* and 21*b*, and FIG. 6B is a front view of the spacers 21*a* and 21*b*. For easier understanding, FIG. 5 illustrates a side view of the optical writing head 61 and the respective areas on the photoconductor 3 and a cross-sectional view of the spacers 21*a* and 21*b* taken along a plane passing through the axis of the photoconductor 3.

In the present embodiment example, the optical writing head positioning mechanism 20 is configured as follows to address the issues of the foregoing related-art example.

The optical writing head 61 of the exposure device 60 according to the present embodiment example includes the light emitting substrate, the lens array 62, and the head frame 63 holding the lens array 62 as in the foregoing related-art example. Further, as illustrated in FIG. 5, the spacers 21*a* and 21*b* of the optical writing head positioning mechanism 20 for positioning the optical writing head 61 are disposed between the photoconductor 3 and the optical writing head 61 at two locations near the opposed ends of the photoconductor 3 in the photoconductor axial direction.

Further, as illustrated in FIG. 6A, the spacer 21*a* on the right side of the drawing includes two head contact surfaces 211*a* in contact with the optical writing head 61, and the spacer 21*b* on the left side of the drawing includes one head contact surface 211*b* in contact with the optical writing head 61. That is, the optical writing head 61 is seated on three head contact surfaces. Further, as illustrated in FIG. 5, the head contact surfaces 211*a* and 211*b* of the spacers 21*a* and 21*b* are disposed to contact portions of the head frame 63 outside the lens array 62 in the photoconductor axial direction.

The optical writing head positioning mechanism 20 of the present embodiment example, however, is different from that of the related-art example in that the spacers 21*a* and 21*b* include the second photoconductor contact surfaces 213*a* and 213*b* in addition to the first photoconductor contact surfaces 212*a* and 212*b* as the carrier contact surfaces that contact the photoconductor 3, as illustrated in FIG. 5. That is, each of the spacers 21*a* and 21*b* includes a plurality of (i.e., two in this case) photoconductor contact surfaces.

Further, as illustrated in FIG. 5 and FIG. 6B, a portion of the spacer 21*a* between the first photoconductor contact surface 212*a* and the second photoconductor contact surface 213*a* and a portion of the spacer 21*b* between the first photoconductor contact surface 212*b* and the second photoconductor contact surface 213*b* are not in contact with the photoconductor 3. Further, the spacers 21*a* and 21*b* are disposed such that the first photoconductor contact surfaces 212*a* and 212*b* and the second photoconductor contact surfaces 213*a* and 213*b* are in contact with locations on the photoconductor 3 other than the cleaning area ends, and that one of the cleaning area ends on the photoconductor 3 is located between the first photoconductor contact surface 212*a* and the second photoconductor contact surface 213*a* and the other one of the cleaning area ends on the photoconductor 3 is located between the first photoconductor contact surface 212*b* and the second photoconductor contact surface 213*b*. That is, the spacers 21*a* and 21*b* are disposed such that the first photoconductor contact surfaces 212*a* and 212*b* and the second photoconductor contact surfaces 213*a* and 213*b* are located not on but straddling the cleaning area ends on the photoconductor 3.

With the above-described configuration, the streaks of residual toner having entered between the photoconductor 3 and the spacers 21*a* and 21*b* are prevented from sticking to the photoconductor 3 and degrading the positioning accuracy of the optical writing head 61 relative to the photoconductor 3.

Since the present configuration is thus capable of preventing the residual toner from sticking to the photoconductor 3 and degrading the positioning accuracy of the optical writing head 61 relative to the photoconductor 3, the degree of design freedom in disposing the spacers 21*a* and 21*b* in the direction perpendicular to the photoconductor axial direction is higher than in the configuration of the related-art example, even if the axial length of each of the spacers 21*a* and 21*b* is the same as the axial length of each of the spacers 2100*a* and 2100*b* of the related-art example. With the degree of design freedom in disposing the spacers 21*a* and 21*b* thus increased, the positions of the spacers 21*a* and 21*b* are determined not based on the positions of the cleaning area ends but based on the ends of the maximum image area of the photoconductor 3 having the length L1.

It is therefore possible to make the axial length of the photoconductor 3 or the cleaning blade 5 shorter than in a configuration having the spacers 2100*a* and 2100*b* of the related-art example or the spacers of one of the foregoing publications.

Accordingly, the optical writing head positioning mechanism 20 of the present embodiment example allows a reduction in size of the process cartridge 2 and the printer 100 while minimizing the deterioration of the positioning accuracy of the optical writing head 61 relative to the photoconductor 3.

It is also possible to further reduce the axial length of the photoconductor 3 by reducing the axial length of the cleaning blade 5.

Further, as illustrated in FIG. 5, for example, in the optical writing head positioning mechanism 20 of the present embodiment example, the first photoconductor contact surfaces 212*a* and 212*b* of the spacers 21*a* and 21*b* are disposed inside the cleaning area of the cleaning blade 5 having the length L3. Therefore, the cleaning residues may accumulate on side surfaces of the spacers 21*a* and 21*b* on the upstream side of the first photoconductor contact surfaces 212*a* and 212*b* in the photoconductor rotation direction.

Unlike the related-art example described above with reference to FIGS. 4A to 4E, however, the present embodiment example includes the second photoconductor contact surfaces 213*a* and 213*b* in addition to the first photoconductor contact surfaces 212*a* and 212*b*. Moreover, the first photoconductor contact surfaces 212*a* and 212*b* and the second photoconductor contact surfaces 213*a* and 213*b* are formed in different shapes (i.e., widths).

That is, the first photoconductor contact surfaces 212*a* and 212*b* inside the cleaning area having the length L3 are shorter in the length (i.e., width) in the photoconductor axial direction than the second photoconductor contact surfaces 213*a* and 213*b* outside the cleaning area. Therefore, the accumulation of cleaning residues inside the cleaning area and on the upstream side of the first photoconductor contact surfaces 212*a* and 212*b* in the photoconductor rotation direction is minimized, reducing chances of the cleaning residues sticking to the photoconductor 3 in the maximum image area having the length L1.

Further, with the axial length of the first photoconductor contact surfaces 212*a* and 212*b* inside the cleaning area set to be shorter than the axial length of the second photoconductor contact surfaces 213*a* and 213*b* outside the cleaning area, it is possible to make the cleaning area narrower than in a configuration having multiple photoconductor contact surfaces of the same shape. It is therefore possible to make the axial length of the photoconductor 3 or the cleaning blade 5 shorter than in the configuration having multiple photoconductor contact surfaces of the same shape.

In the configuration of the present embodiment example described above, the spacer 21*a* includes the first photoconductor contact surface 212*a* and the second photoconductor contact surface 213*a*, and the spacer 21*b* includes the first photoconductor contact surface 212*b* and the second photoconductor contact surface 213*b*, with one of the cleaning area ends located between the first photoconductor contact surface 212*a* and the second photoconductor contact surface 213*a* of the spacer 21*a* and the other one of the cleaning area ends located between the first photoconductor contact surface 212*b* and the second photoconductor contact surface 213*b* of the spacer 21*b*. This disclosure, however, is not limited thereto.

For example, alternatively, only the spacer 21*a* may be configured to include the first photoconductor contact surface 212*a* and the second photoconductor contact surface 213*a*, straddling one of the cleaning area ends.

With at least one of the spacers 21*a* and 21*b* thus configured, it is possible to make the axial length of the photoconductor 3 or the cleaning blade 5 shorter than in the configuration of the foregoing related-art example and the configurations of the foregoing publications.

However, it is possible to make the axial length of the photoconductor 3 or the cleaning blade 5 shorter in the above-described configuration, in which the spacer 21*a* includes the first photoconductor contact surface 212*a* and the second photoconductor contact surface 213*a*, and the spacer 21*b* includes the first photoconductor contact surface 212*b* and the second photoconductor contact surface 213*b*, with one of the cleaning area ends located between the first photoconductor contact surface 212*a* and the second photoconductor contact surface 213*a* and the other one of the cleaning area ends located between the first photoconductor contact surface 212*b* and the second photoconductor contact surface 213*b*, than in the configuration in which only one of the spacers 21*a* and 21*b* includes the first photoconductor contact surface 212*a* or 212*b* and the second photoconductor contact surface 213*a* or 213*b*.

Further, in the configuration of present embodiment example described above, each of the spacers 21*a* and 21*b* includes two photoconductor contact surfaces, i.e., the spacer 21*a* includes the first photoconductor contact surface 212*a* and the second photoconductor contact surface 213*a*, and the spacer 21*b* includes the first photoconductor contact surface 212*b* and the second photoconductor contact surface 213*b*. This disclosure, however, is not limited to this configuration.

For example, alternatively a third photoconductor contact surface a may be provided between the first photoconductor contact surface 212*a* and the second photoconductor contact surface 213*a* of the spacer 21*a*, and a third photoconductor contact surface b may be provided between the first photoconductor contact surface 212*b* and the second photoconductor contact surface 213*b* of the spacer 21*b*. Further, the spacers 21*a* and 21*b* may be disposed such that one of the cleaning area ends is located between the first photoconductor contact surface 212*a* and the third photoconductor contact surface a, and that the other one of the cleaning area ends is located between the first photoconductor contact surface 212*b* and the third photoconductor contact surface b.

With the thus-disposed three or more photoconductor contact surfaces, it is possible to reduce the length (i.e., width) in the photoconductor axial direction of the photoconductor contact surfaces, and reduce the axial length of the first photoconductor contact surfaces 212*a* and 212*b* provided inside the cleaning area. It is also possible to reduce the amount of cleaning residues accumulating on the upstream end portions of the spacers 21*a* and 21*b* in the photoconductor rotation direction, thereby minimizing image failures attributed to the cleaning residues accumulating on and stuck to the photoconductor 3.

The spacers 21*a* and 21*b* each having two photoconductor contact surfaces, however, are less susceptible to processing errors and abrasion than the spacers 21*a* and 21*b* each having three or more photoconductor contact surfaces, and thus attain a stable state of contact between the photoconductor 3 and the photoconductor contact surfaces.

Further, equipped with the optical writing head positioning mechanism 20 of the present embodiment example described above, the process cartridge 2 and the printer 100 are capable of obtaining effects similar to those of the optical writing head positioning mechanism 20.

A second embodiment example will now be described.

With reference to drawings, description will be given of a second embodiment example of the configuration of the optical writing head positioning mechanism 20 included in the process cartridge 2 of the printer 100 according to the present embodiment.

Figure 7A:
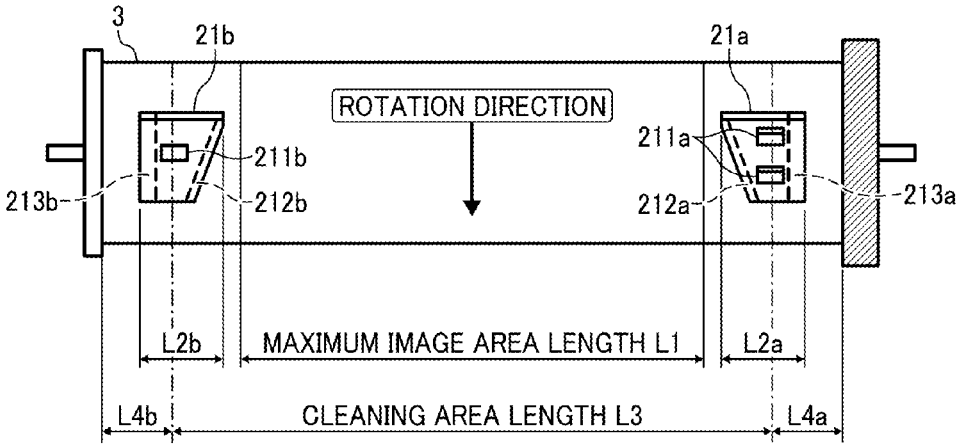
FIGS. 7A and 7B are diagrams illustrating the relationship between first photoconductor contact surfaces and second photoconductor contact surfaces of spacers according to a second embodiment example and the end portions of the cleaning area of the cleaning blade.
Figure 7B:
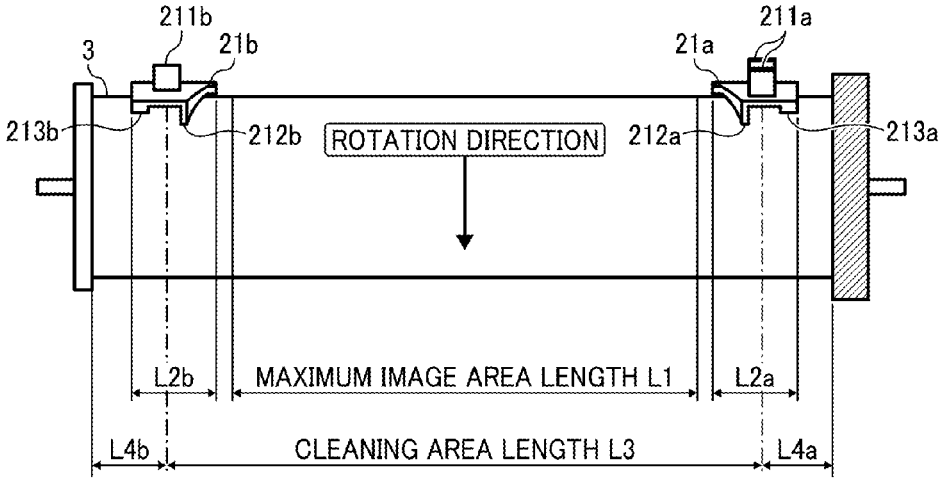

FIGS. 7A and 7B are diagrams illustrating the relationship between the first photoconductor contact surfaces 212*a* and 212*b* and the second photoconductor contact surfaces 213*a* and 213*b* of the spacers 21*a* and 21*b* according to the present embodiment example and the end portions of the cleaning area of the cleaning blade 5 having the length L3. FIG. 7A is a top view of the spacers 21*a* and 21*b*, and FIG. 7B is a front view of the spacers 21*a* and 21*b*.

Figure 8A:
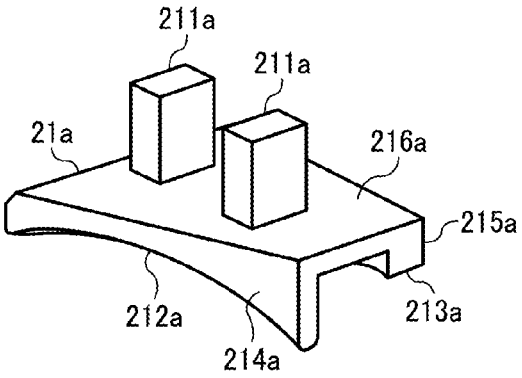
FIGS. 8A to 8D are diagrams illustrating one of the spacers according to the second embodiment example.
Figure 8B:
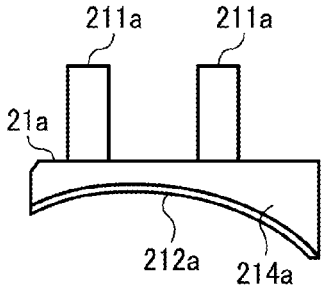
Figure 8C:
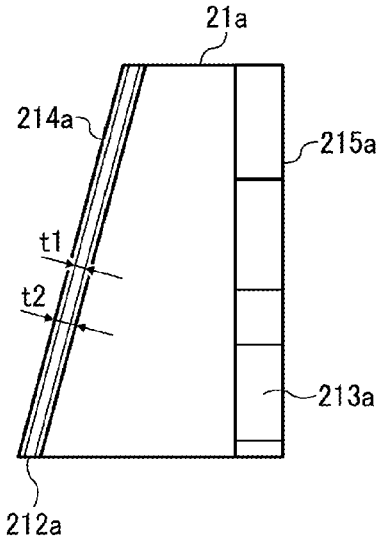
Figure 8D:
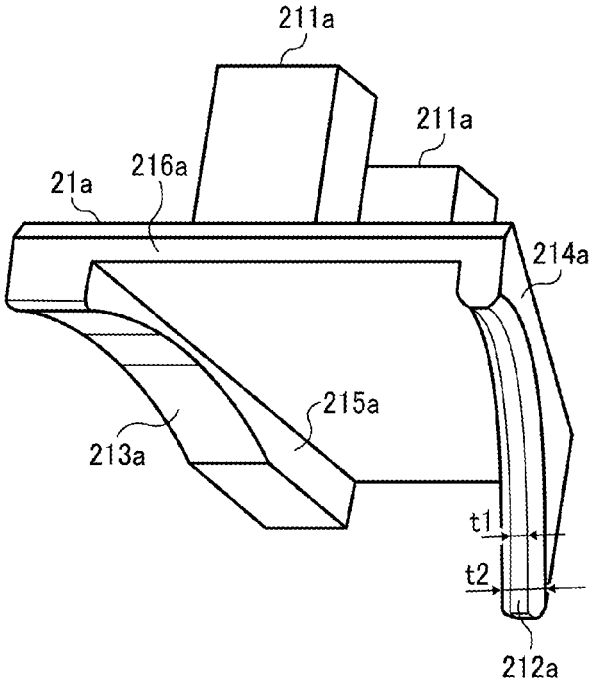
Figure 9:
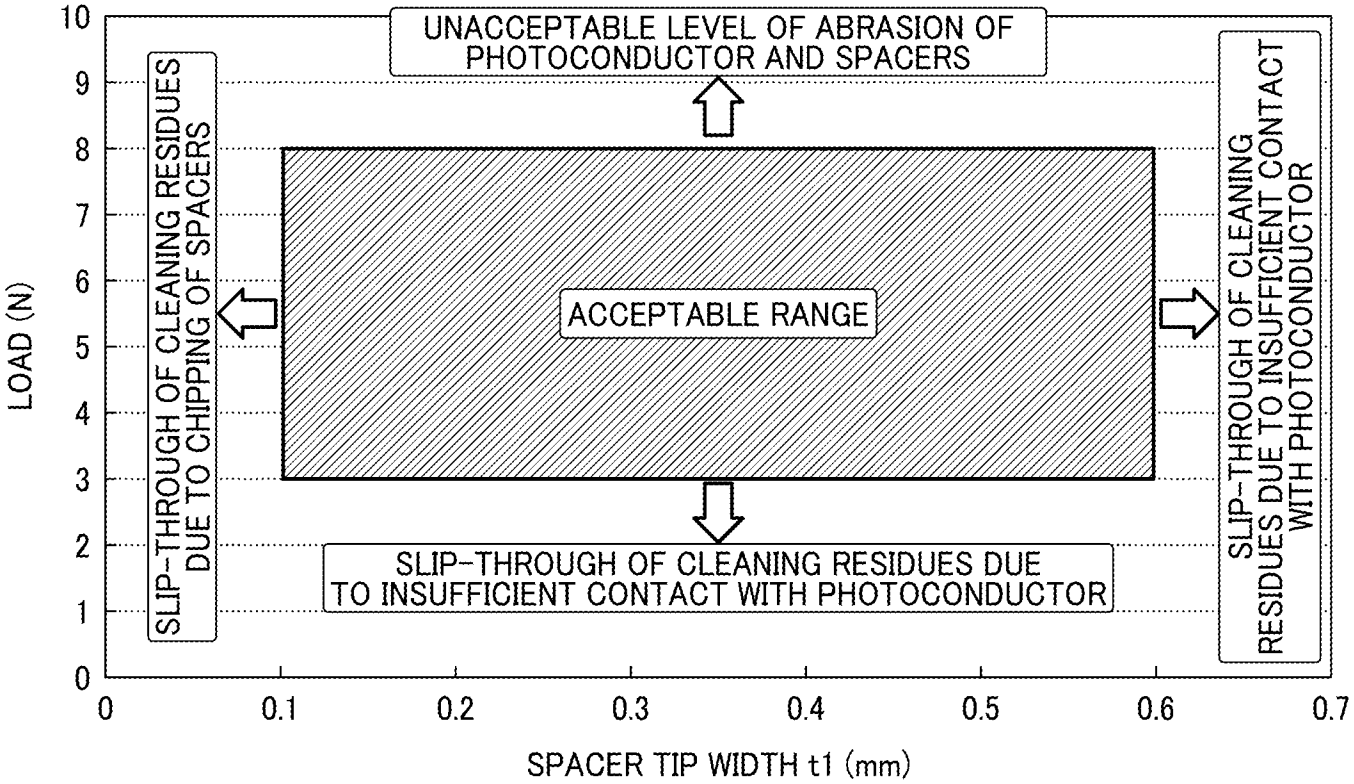
FIG. 9 is a graph illustrating the relationship between a load and a tip width corresponding to the width of the first photoconductor contact surface of the one of the spacers according to the second embodiment example.

FIGS. 8A to 8D are diagrams illustrating the spacer 21*a* according to the present embodiment example. FIG. 8A is a perspective view of the spacer 21*a* as viewed from diagonally above. FIG. 8B is a side view of the spacer 21*a* as viewed from inside in the photoconductor axial direction. FIG. 8C is a bottom view of the spacer 21*a* as viewed from the side of the photoconductor 3. FIG. 8D is a perspective view of the spacer 21*a* as viewed from diagonally below, illustrating a tip width t1 corresponding to the width of the first photoconductor contact surface 212*a* of the spacer 21*a* and a rib width t2 corresponding to the width of a proximal portion of a rib 214*a* provided with the first photoconductor contact surface 212*a*. FIG. 9 is a graph illustrating the relationship between a load and the tip width t1 corresponding to the width of each of the first photoconductor contact surfaces 212*a* and 212*b* of the spacers 21*a* and 21*b* according to the present embodiment example.

The optical writing head positioning mechanism 20 of the present embodiment example is different from the optical writing head positioning mechanism 20 of the above-described first embodiment example only in the shape of the spacers 21*a* and 21*b*. In the following description, therefore, configurations similar to those of the above-described first embodiment example and the related-art example and the operations and effects of the configurations will be omitted where appropriate. Further, like reference numerals designate identical components or components having similar functions, unless there is a need to distinguish the components.

As described above, in the optical writing head positioning mechanism 20 of the present embodiment example, the first photoconductor contact surfaces 212*a* and 212*b* of the spacers 21*a* and 21*b* are tilted relative to the photoconductor rotation direction, unlike the first photoconductor contact surfaces 212*a* and 212*b* of the spacers 21*a* and 21*b* in the above-described first embodiment example. The present embodiment example is similar to the first embodiment example in that the spacers 21*a* and 21*b* are disposed such that one of the cleaning area ends is located between the first photoconductor contact surface 212*a* and the second photoconductor contact surface 213*a* and the other one of the cleaning area ends is located between the first photoconductor contact surface 212*b* and the second photoconductor contact surface 213*b*. That is, the spacers 21*a* and 21*b* are disposed such that the first photoconductor contact surfaces 212*a* and 212*b* and the second photoconductor contact surfaces 213*a* and 213*b* are located not on but straddling the cleaning area ends on the photoconductor 3. Therefore, the second embodiment example is capable of obtaining effects similar to those of the above-described first embodiment example.

Further, as illustrated in FIGS. 7A and 7B, the spacer 21*a* on the right side of the drawings includes two head contact surfaces 211*a* in contact with the optical writing head 61, and the spacer 21*b* on the left side of the drawings includes one head contact surface 211*b* in contact with the optical writing head 61. That is, the optical writing head 61 is seated on the three head contact surfaces.

Further, the spacers 21*a* and 21*b* are configured such that the first photoconductor contact surfaces 212*a* and 212*b* of the spacers 21*a* and the 21*b* are tilted relative to the photoconductor rotation direction from inside to outside in the photoconductor axial direction from upstream to downstream in the photoconductor rotation direction.

With this tilt, the cleaning residues are prevented from accumulating on the upstream side of the first photoconductor contact surfaces 212*a* and 212*b* of the spacers 21*a* and 21*b* in the photoconductor rotation direction. The present embodiment example is therefore capable of minimizing image failures unlike the related-art example described above with reference to FIGS. 4A to 4E.

Specifically, with the tilted first photoconductor contact surfaces 212*a* and 212*b* inside the cleaning area, the cleaning residues on the upstream side of the first photoconductor contact surfaces 212*a* and 212*b* in the photoconductor rotation direction are moved (i.e., swept) along the tilt. It is therefore possible to minimize the accumulation of cleaning residues inside the cleaning area and on the upstream side of the first photoconductor contact surfaces 212*a* and 212*b* in the photoconductor rotation direction, and thereby reduce chances of the cleaning residues sticking to the photoconductor 3 in the maximum image area having the length L1.

Further, since the first photoconductor contact surfaces 212*a* and 212*b* disposed on the central side of the photoconductor 3 are tilted away from the center of the photoconductor 3 from upstream to downstream in the photoconductor rotation direction, it is possible to move the cleaning residues along the tilt away from the maximum image area having the length L1. With the cleaning residues thus moved away from the maximum image area, the present configuration is capable of reducing the chances of the cleaning residues sticking to the photoconductor 3 in the maximum image area and thus minimizing image failures more effectively than the configuration of the foregoing first embodiment example.

The configuration of the spacers 21*a* and 21*b* provided in the optical writing head positioning mechanism 20 of the present embodiment example will now be described in detail.

The spacers 21*a* and 21*b* are substantially symmetrical in shape in the photoconductor axial direction, and are substantially similar in configuration except for the number of the head contact surfaces 211*a* and 211*b* in contact with the optical writing head 61. Therefore, the following description will be given only of the spacer 21*a*.

The spacer 21*a* of the present embodiment example includes two photoconductor contact surfaces that contact the photoconductor 3, i.e., the first photoconductor contact surface 212*a* and the second photoconductor contact surface 213*a*, similarly to the spacer 21*a* of the first embodiment example.

Specifically, as illustrated in FIGS. 8A to 8D, the spacer 21*a* includes the two head contact surfaces 211*a* in contact with the optical writing head 61 and the two photoconductor contact surfaces in contact with the photoconductor 3, i.e., the first photoconductor contact surface 212*a* and the second photoconductor contact surface 213*a*. When the optical writing head 61 comes into contact with the head contact surfaces 211*a*, the head contact surfaces 211*a* receive a load exerted thereon from the optical writing head 61 toward the photoconductor 3 by a biasing device such as a coil spring.

The first photoconductor contact surface 212*a* and the second photoconductor contact surface 213*a* are formed on respective tips of ribs 214*a* and 215*a* formed on a lower surface (i.e., a photoconductor-side surface) of a planar portion 216*a* of the spacer 21*a* opposite to an upper surface of the planar portion 216*a* provided with the head contact surfaces 211*a*. The spacer 21*a* includes only two ribs, i.e., the rib 214*a* formed with the first photoconductor contact surface 212*a* and the rib 215*a* formed with the second photoconductor contact surface 213*a*, which are spaced from each other, as illustrated in FIG. 8C.

Further, as illustrated in FIGS. 8B and 8C, the first photoconductor contact surface 212*a* corresponding to a tip of a cut-off portion of the rib 214*a* in contact with the photoconductor 3 is tilted and arc-shaped. Further, as described above, the first photoconductor contact surface 212*a* corresponding to a contact surface of a tilted portion of the spacer 21*a* is the tip of the rib 214*a* provided to the spacer 21*a*. Therefore, the first photoconductor contact surface 212*a* easily elastically deforms to fill a gap between the photoconductor 3 and the spacer 21*a*, thereby minimizing slip-through of cleaning residues.

Further, as illustrated in FIGS. 8C and 8D, the tip width t1 corresponding to the width of the first photoconductor contact surface 212*a* that contacts the photoconductor 3 is narrower (i.e., less) than the rib width t2 corresponding to the width of the proximal portion of the rib 214*a* provided with the first photoconductor contact surface 212*a*. The thus-configured first photoconductor contact surface 212*a* elastically deforms and contacts the photoconductor 3 more easily than the first photoconductor contact surface 212*a* having the tip width t1 equal to the rib width t2.

With reference to FIG. 9, description will now be given of the results of an experiment conducted by the inventors to examine the cleaning residue removal effect and the change in durability of the photoconductor 3 and the spacer 21*a* with different values of the tip width t1 and the load on the spacer 21*a*. The results illustrated in FIG. 9 were obtained from an experiment conducted under the following conditions.

The linear velocity and the diameter of the photoconductor 3 were set to 240 mm/s and 30 mm, respectively, and the two head contact surfaces 211*a* were subjected to pressure as a method of pressing the spacer 21*a*. As to the shape of the first photoconductor contact surface 212*a*, the angle of the rib 214*a* to the photoconductor rotation direction (i.e., the second photoconductor contact surface 213*a*) was set to 23°, and the length of the first photoconductor contact surface 212*a* as projected on a plane provided with the rib 215*a* perpendicular to the photoconductor axial direction was set to 12.8 mm. As to the shape of the second photoconductor contact surface 213*a*, the length (i.e., width) of the second photoconductor contact surface 213*a* in the photoconductor axial direction was set to 2.0 mm, and the length of an arc portion of the second photoconductor contact surface 213*a* in contact with the photoconductor 3 was set to 9.7 mm.

As illustrated in FIG. 9, the narrower the tip width t1 corresponding to the width of the first photoconductor contact surface 212*a* at the tip of the spacer 21*a* is, the easier it is to bring the first photoconductor contact surface 212*a* into contact with the photoconductor 3. If the tip width t1 is too narrow, however, it is difficult to manufacture the spacer 21*a*, and a tip portion of the rib 214*a* of the spacer 21*a* provided with the first photoconductor contact surface 212*a* may chip owing to deposits on the photoconductor 3. Such chipping of the tip portion of the rib 214*a* results in slip-through of cleaning residues on the photoconductor 3, preventing desirable removal of the cleaning residues.

To minimize such chipping of the tip portion of the rib 214*a*, it is desirable to set the tip width t1 to 0.1 mm or greater, as illustrated in FIG. 9.

By contrast, the greater the tip width t1 corresponding to the width of the first photoconductor contact surface 212*a* of the spacer 21*a* is, the easier it is to manufacture the spacer 21*a*, but the more difficult it is to bring the first photoconductor contact surface 212*a* into contact with the photoconductor 3. If it is thus difficult to bring the first photoconductor contact surface 212*a* at the tip of the rib 214*a* into contact with the photoconductor 3, a gap is formed between the first photoconductor contact surface 212*a* and the photoconductor 3, allowing slip-through of cleaning residues on the photoconductor 3 and hindering desirable removal of the cleaning residues.

To minimize such formation of a gap between the photoconductor 3 and the first photoconductor contact surface 212*a*, it is desirable to set the tip width t1 to 0.6 mm or less, as illustrated in FIG. 9.

Further, the greater the load on the spacer 21*a* is, the easier it is to bring the spacer 21*a* into contact with the photoconductor 3. In this case, however, the abrasion of the photoconductor 3 and the spacer 21*a* progresses, and the durability of the photoconductor 3 and the spacer 21*a* deteriorates near the end of a durability test, as indicated as UNACCEPTABLE LEVEL OF ABRASION in FIG. 9. Further, the optical writing head 61 and the photoconductor 3 approach too closely, causing defocusing of the optical writing head 61.

To minimize such deterioration of the durability of the photoconductor 3 and the spacer 21*a*, it is desirable to set the load on the spacer 21*a* to 8 N or less, as illustrated in FIG. 9.

By contrast, if the load on the spacer 21*a* is reduced, the abrasion of the photoconductor 3 and the spacer 21*a* is minimized, improving the durability of the photoconductor 3 and the spacer 21*a*. However, it is difficult to bring the first photoconductor contact surface 212*a* of the spacer 21*a* into contact with the photoconductor 3. If it is thus difficult to bring the first photoconductor contact surface 212*a* at the tip of the rib 214*a* into contact with the photoconductor 3, a gap is formed between the first photoconductor contact surface 212*a* and the photoconductor 3, allowing slip-through of cleaning residues on the photoconductor 3 and hindering desirable removal of cleaning residues.

To prevent such formation of a gap between the photoconductor 3 and the first photoconductor contact surface 212*a*, it is desirable to set the load on the spacer 21*a* to 3 N or greater, as illustrated in FIG. 9.

Based on the above-described results, it is considered desirable in the configuration of the present embodiment example to set the tip width t1 of the first photoconductor contact surface 212*a* at the tip of the spacer 21*a* in a range from 0.1 mm to 0.6 mm and set the load on the spacer 21*a* in a range from 3 N to 8 N.

That is, if the tip width t1 of the tilted first photoconductor contact surface 212*a* formed at the tip of the rib 214*a* of the spacer 21*a* is set in the range from 0.1 mm to 0.6 mm, it is possible to minimize chipping of the tilted first photoconductor contact surface 212*a* formed on the spacer 21*a* due to cleaning residues adhering to the surface of the photoconductor 3, and minimize slipping of cleaning residues through a gap formed between the tiled first photoconductor contact surface 212*a* and the photoconductor 3 due to insufficient contact between the first photoconductor contact surface 212*a* and the photoconductor 3.

Further, if the load on the spacer 21*a* is set in the range from 3 N to 8 N, it is possible to minimize defocusing of the optical writing head 61 attributed to the degraded positioning accuracy of the optical writing head 61 relative to the photoconductor 3 resulting from the abrasion of the photoconductor 3 and the spacer 21*a*, and minimize slip-though of cleaning residues due to insufficient contact between the tilted first photoconductor contact surface 212*a* formed on the spacer 21*a* and the photoconductor 3.

A third embodiment example will now be described.

With reference to drawings, description will be given of a third embodiment example of the configuration of the optical writing head positioning mechanism 20 included in the process cartridge 2 of the printer 100 according to the present embodiment.

Figure 10A:
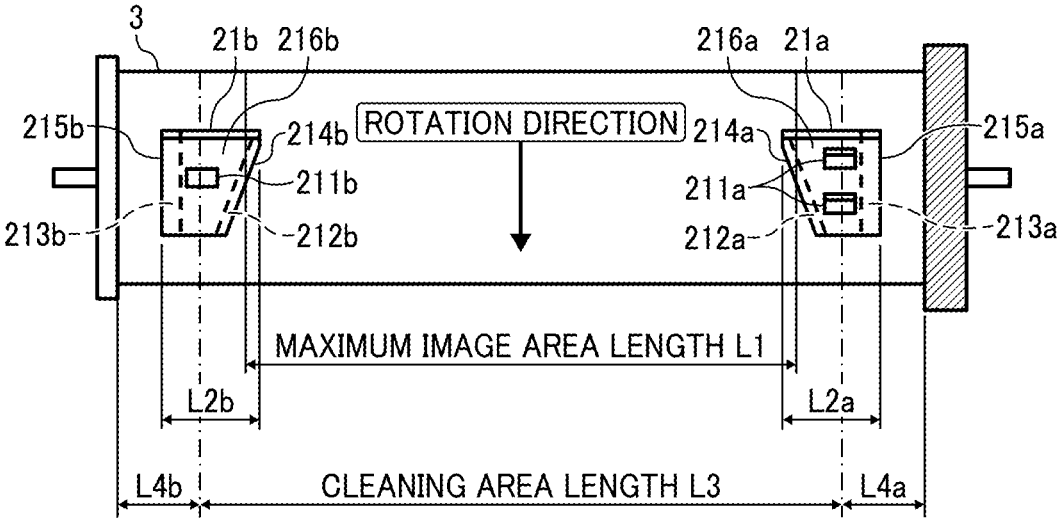
FIGS. 10A and 10B are diagrams illustrating the relationship between first photoconductor contact surfaces and second photoconductor contact surfaces of spacers according to a third embodiment example and the end portions of the cleaning area of the cleaning blade.
Figure 10B:
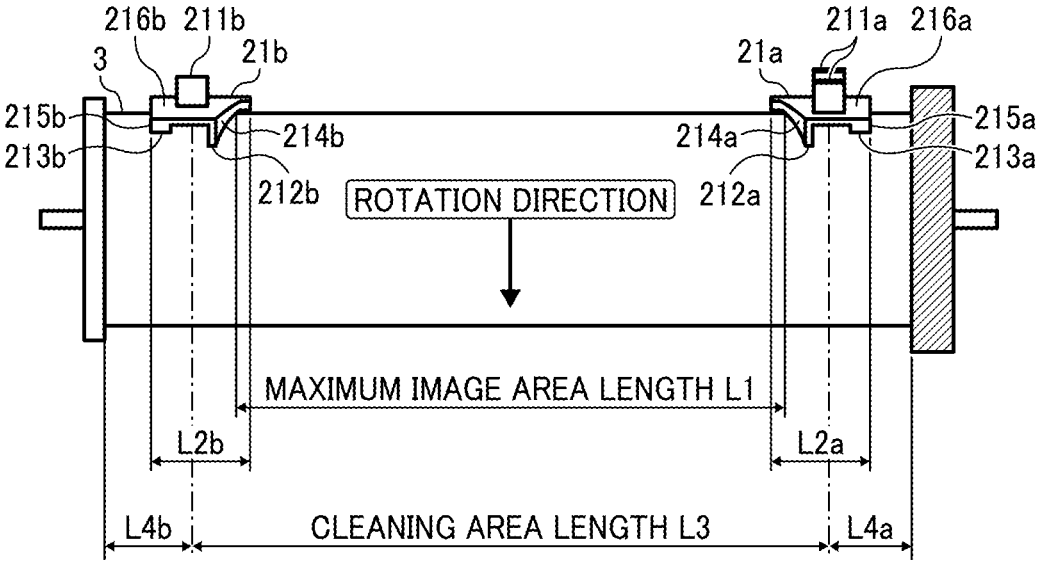

FIGS. 10A and 10B are diagrams illustrating the relationship between the first photoconductor contact surfaces 212*a* and 212*b* and the second photoconductor contact surfaces

213*a* and 213*b* of the spacers 21*a* and 21*b* according to the present embodiment example and the end portions of the cleaning area of the cleaning blade 5.

The optical writing head positioning mechanism 20 of the present embodiment example is different from the optical writing head positioning mechanism 20 of the above-described second embodiment example only in the disposition of the spacers 21*a* and 21*b*. In the following description, therefore, configurations similar to those of the above-described first and second embodiment examples and the related-art example and the operations and effects of the configurations will be omitted where appropriate. Further, like reference numerals designate identical components or components having similar functions, unless there is a need to distinguish the components.

The optical writing head positioning mechanism 20 of the present embodiment example is different from the optical writing head positioning mechanism 20 of the above-described second embodiment example only in that inner end portions in the photoconductor axial direction of the first photoconductor contact surfaces 212*a* and 212*b* are disposed inside the maximum image area having the length L1.

Specifically, as illustrated in FIGS. 10A and 10B, the spacers 21*a* and 21*b* of the optical writing head positioning mechanism 20 of the present embodiment example are disposed more inside in the photoconductor axial direction than the spacers 21*a* and 21*b* of the above-described second embodiment example. Further, the tilted first photoconductor contact surfaces 212*a* and 212*b* of the spacers 21*a* and 21*b* are disposed such that an upstream end portion in the photoconductor rotation direction of the rib 214*a* having a tip portion formed with the first photoconductor contact surface 212*a* and an upstream end portion in the photoconductor rotation direction of the rib 214*b* having a tip portion formed with the first photoconductor contact surface 212*b* are located inside the maximum image area having the length L1, and that respective downstream end portions in the photoconductor rotation direction of the ribs 214*a* and 214*b* are located outside the maximum image area having the length L1. Herein, the spacers 21*a* and 21*b* are disposed at respective positions at which the ribs 214*a* and 214*b* having the tip portions formed with the first photoconductor contact surfaces 212*a* and 212*b*, respectively, do not obstruct the maximum image area of the photoconductor 3 having the length L1, in which optical writing by the optical writing head 61 takes place.

That is, the first photoconductor contact surfaces 212*a* and 212*b* of the optical writing head positioning mechanism 20 disposed on the central side in the photoconductor axial direction are tilted to contact the photoconductor 3 from inside to outside the maximum image area of the photoconductor 3 from upstream to downstream in the photoconductor rotation direction.

With the thus-configured optical writing head positioning mechanism 20, it is possible to cause cleaning residues inside the maximum image area and on the upstream side in the photoconductor rotation direction of the first photoconductor contact surfaces 212*a* and 212*b* disposed on the central side in the photoconductor axial direction to move out of the maximum image area. It is therefore possible to reduce chances of the cleaning residues sticking to the photoconductor 3 in the maximum image area and minimize image failures more effectively than in the configuration of the above-described second embodiment example. That is, it is possible to substantially reduce the chances of the cleaning residues sticking to the photoconductor 3 in the maximum image area and thereby further minimize image failures. Further, since the spacers 21*a* and 21*b* are disposed more inside in the photoconductor axial direction than in the above-described second embodiment example, it is also possible to make the axial length of the photoconductor 3 shorter than in the configuration of the second embodiment example.

Further, in the configuration of the above-described second embodiment example, a slight amount of cleaning residues may fall into an inner area in the photoconductor axial direction from the upstream end portions in the photoconductor rotation direction of the first photoconductor contact surfaces 212*a* and 212*b*, without being moved to the outside in the photoconductor axial direction. As a result, a slight amount of cleaning residues may stick to the photoconductor 3 near the inner end portions in the photoconductor axial direction of the first photoconductor contact surfaces 212*a* and 212*b*. If the image forming operations continue for an extended period of time with the stuck cleaning residues left on the photoconductor 3, further residual toner and so forth may adhere onto the stuck cleaning residues, thereby growing the stuck deposits and eventually causing an image failure.

By contrast, if the upstream end portions in the photoconductor rotation direction of the first photoconductor contact surfaces 212*a* and 212*b* are disposed inside the maximum image area, as in the configuration of the present embodiment example, a slight amount of cleaning residues falls from the upstream end portions into the maximum image area.

Even if the cleaning residues within the maximum image area stick to the photoconductor 3, the cleaning residues are scraped off when passing through the cleaning blade 5 next time owing to the grinding effect of post-transfer residual toner. Further, toner may periodically be supplied to the photoconductor 3 for cleaning purposes to actively remove the above-described stuck deposits.

A fourth embodiment example will now be described.

With reference to drawings, description will be given of a fourth embodiment example of the configuration of the optical writing head positioning mechanism 20 included in the process cartridge 2 of the printer 100 according to the present embodiment.

Figure 11A:
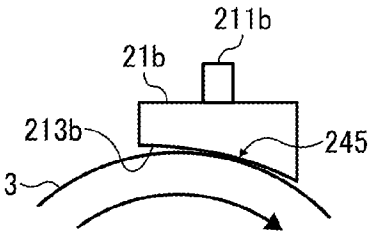
FIGS. 11A to 11F are diagrams illustrating states of contact between a first photoconductor contact surface and a second photoconductor contact surface of a spacer according to a fourth embodiment example and a photoconductor surface.
Figure 11B:
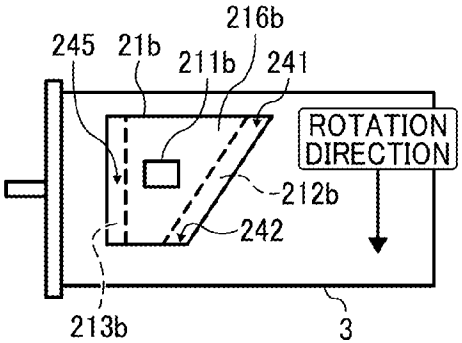
Figure 11C:
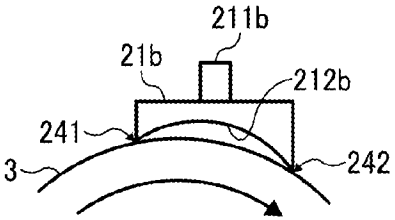
Figure 11D:
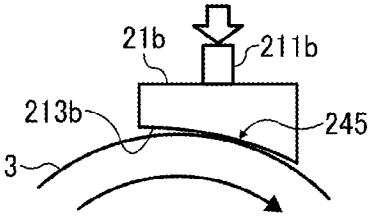
Figure 11E:
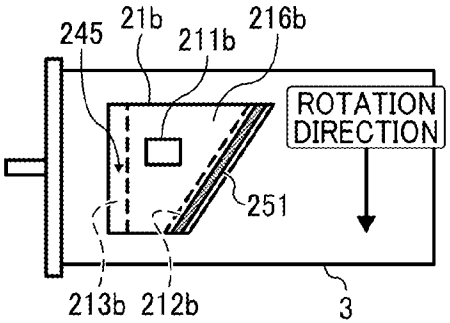
Figure 11F:
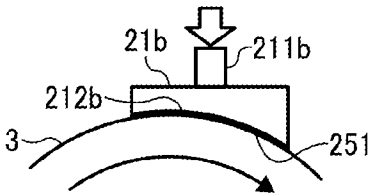

FIGS. 11A to 11F are diagrams illustrating states of contact between the surface of the photoconductor 3 and the first photoconductor contact surface 212*b* and the second photoconductor contact surface 213*b* of the spacer 21*b* according to the present embodiment example. FIGS. 11A to 11C illustrate the state before the spacer 21*b* is biased by the biasing device, and FIGS. 11D to 11F illustrate the state after the spacer 21*b* is biased by the biasing device in the direction of the arrow in FIGS. 11A and 11F.

The optical writing head positioning mechanism 20 of the present embodiment example is different from the optical writing head positioning mechanisms 20 of the above-described second and third embodiment examples only in that the respective shapes of the spacers 21*a* and 21*b* before being biased by the biasing device are specified. In the following description, therefore, configurations similar to those of the above-described first to third embodiment examples and the related-art example and the operations and effects of the configurations will be omitted where appropriate. Further, like reference numerals designate identical components or components having similar functions, unless there is a need to distinguish the components.

As described above in the second embodiment example, in the optical writing head positioning mechanisms 20 of the above-described second and third embodiment examples, when the optical writing head 61 comes into contact with the head contact surfaces 211*a* and 211*b*, the head contact surfaces 211*a* and 211*b* receive a load exerted from the optical writing head 61 toward the photoconductor 3 by the biasing device. With this load, at least the first photoconductor contact surfaces 212*a* and 212*b* of the spacers 21*a* and 21*b* elastically deform to fill a gap between the spacers 21*a* and 21*b* and the photoconductor 3, minimizing slip-through of cleaning residues, as described above in the second embodiment example. Preferable ranges of the tip width t1 of each of the first photoconductor contact surfaces 212*a* and 212*b* in contact with the photoconductor 3 and the load on the spacers 21*a* and 21*b* are as described above.

The second and third embodiment examples only specify that each of the first photoconductor contact surfaces 212*a* and 212*b* has an arc shape before the first photoconductor contact surfaces 212*a* and 212*b* and the second photoconductor contact surfaces 213*a* and 213*b* are biased against the photoconductor 3 by the biasing device.

When the spacers 21*a* and 21*b* are biased against the photoconductor 3 by the biasing device, however, the positions and postures of the spacers 21*a* and 21*b* may become unstable owing to processing errors or installation errors of the spacers 21*a* and 21*b*. If the positions and postures of the spacers 21*a* and 21*b* thus become unstable, there arise differences between the designed positions and postures and the actual positions and postures of the first photoconductor contact surfaces 212*a* and 212*b* and the second photoconductor contact surfaces 213*a* and 213*b* in contact with the photoconductor 3, resulting in a failure to obtain a desired distance between the optical writing head 61 and the photoconductor 3. That is, normal positioning of the optical writing head 61 is hindered.

Further, pressure between the photoconductor 3 and one of the first photoconductor contact surfaces 212*a* and 212*b* and the second photoconductor contact surfaces 213*a* and 213*b* in contact with the photoconductor 3 is increased, and the photoconductor 3 and the one of the first photoconductor contact surfaces 212*a* and 212*b* and the second photoconductor contact surfaces 213*a* and 213*b* subjected to the pressure are increasingly worn and scratched.

In the spacers 21*a* and 21*b* of the present embodiment example, therefore, the radii of curvature of the first photoconductor contact surfaces 212*a* and 212*b* and the second photoconductor contact surfaces 213*a* and 213*b* are set (i.e., specified) such that the radius of curvature of the first photoconductor contact surfaces 212*a* and 212*b* tilted relative to the photoconductor rotation direction is smaller than the radius of curvature of the photoconductor 3, and that the radius of curvature of the second photoconductor contact surfaces 213*a* and 213*b* is greater than the radius of curvature of the photoconductor 3.

The spacers 21*a* and 21*b* of the present embodiment example are different only in the number and position of the head contact surfaces 211*a* and 211*b* on the respective planar portions 216*a* and 216*b* of the spacers 21*a* and 21*b*. The following specific description, therefore, will be given only of the spacer 21*b*.

In the present embodiment example, the respective shapes of the first photoconductor contact surface 212*b* and the second photoconductor contact surface 213*b* before the spacer 21*b* is biased by the biasing device are set such that the radius of curvature of the first photoconductor contact surface 212*b* is smaller than the radius of curvature of the photoconductor 3, as illustrated in FIG. 11C, and that the radius of curvature of the second photoconductor contact surface 213*b* is greater than the radius of curvature of the photoconductor 3, as illustrated in FIG. 11A.

With the thus-set radii of curvature of the first photoconductor contact surface 212*b* and the second photoconductor contact surface 213*b*, the first photoconductor contact surface 212*b* before being biased by the biasing device contacts the photoconductor 3 at a first contact location 241 corresponding to the upstream end portion in the photoconductor rotation direction of the first photoconductor contact surface 212*b* and a second contact location 242 corresponding to the downstream end portion in the photoconductor rotation direction of the first photoconductor contact surface 212*b*, as illustrated in FIG. 11C. Further, the second photoconductor contact surface 213*b* before being biased by the biasing device contacts the photoconductor 3 at a third contact location 245 between an upstream end portion and a downstream end portion of the second photoconductor contact surface 213*b* in the photoconductor rotation direction, as illustrated in FIG. 11A.

At each of the first contact location 241, the second contact location 242, and the third contact location 245, the spacer 21*b* is substantially in point-contact with the photoconductor 3 in a cross section in the photoconductor axial direction, and the spacer 21*b* contacts the photoconductor 3 at three locations, as illustrated in a plan view of FIG. 11B.

When the spacer 21*b* is biased by the biasing device, the first photoconductor contact surface 212*b* elastically deforms to come into surface-contact with a portion of the photoconductor 3 facing the first photoconductor contact surface 212*b* in a first contact area 251 corresponding to the entirety of the first photoconductor contact surface 212*b*, as illustrated in FIG. 11F. By contrast, the second photoconductor contact surface 213*b* slightly elastically deforms to come into substantially point-contact with a portion of the photoconductor 3 facing the second photoconductor contact surface 213*b* at the small third contact location 245.

As described above, the first photoconductor contact surface 212*b* and the photoconductor 3 come into close surface-contact with each other, thereby more effectively minimizing the entry of cleaning residues into between the first photoconductor contact surface 212*b* and the photoconductor 3.

In addition, the spacer 21*b* contacts the photoconductor 3 with the first photoconductor contact surface 212*b* surface-contacted with the photoconductor 3 and the second photoconductor contact surface 213*b* substantially point-contacted with the photoconductor 3. That is, even if the axis of a curved surface of the first photoconductor contact surface 212*b* in contact with the photoconductor 3 and the axis of a curved surface of the second photoconductor contact surface 213*b* in contact with the photoconductor 3 slightly deviate from each other, the position (i.e., location) and posture of the spacer 21*b* in contact with the photoconductor 3 are not substantially changed, thereby maintaining a constant distance between the optical writing head 61 and the photoconductor 3.

Further, not both of the first photoconductor contact surface 212*b* and the second photoconductor contact surface 213*b* of the spacer 21*b* but only the first photoconductor contact surface 212*b* should be deformed by a load when biased by the biasing device. It is therefore sufficient to place a small load on the spacer 21*b*.

Moreover, both before and after the load is placed, the spacer 21*b* and the photoconductor 3 are in contact with each other at two locations, i.e., the first photoconductor contact surface 212*b* surface-contacted with the photoconductor 3 and the second photoconductor contact surface 213*b* substantially point-contacted with the photoconductor 3. That is, the spacer 21*b* and the photoconductor 3 are in contact with each other at least three points. Therefore, the spacer 21*b* maintains a constant position relative to the photoconductor 3, thereby maintaining a constant distance between the optical writing head 61 and the photoconductor 3.

A fifth embodiment example will now be described.

With reference to drawings, description will be given of a fifth embodiment example of the configuration of the optical writing head positioning mechanism 20 included in the process cartridge 2 of the printer 100 according to the present embodiment.

Figure 12A:
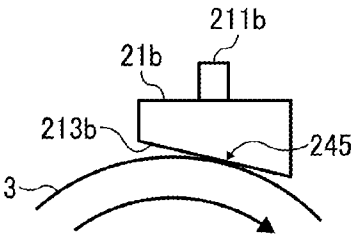
FIGS. 12A to 12F are diagrams illustrating states of contact between a first photoconductor contact surface and a second photoconductor contact surface of a spacer according to a fifth embodiment example and the photoconductor surface.
Figure 12B:
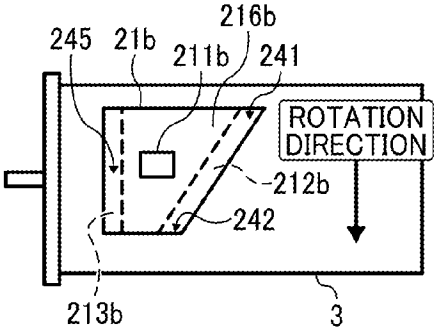
Figure 12C:
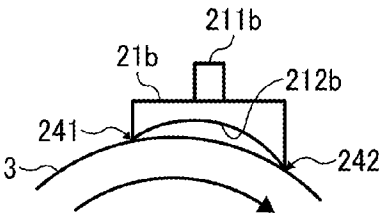
Figure 12D:
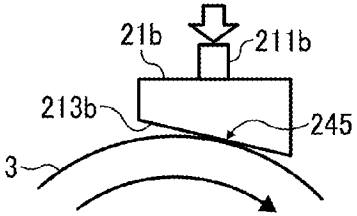
Figure 12E:
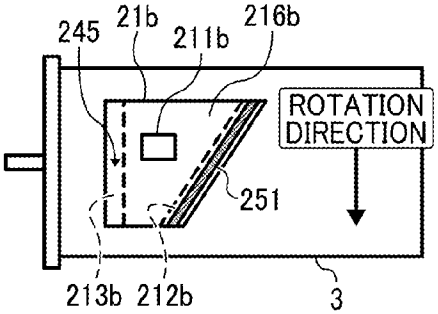
Figure 12F:
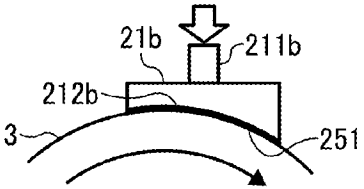

FIGS. 12A to 12F are diagrams illustrating states of contact between the surface of the photoconductor 3 and the first photoconductor contact surface 212*b* and the second photoconductor contact surface 213*b* of the spacer 21*b* according to the present embodiment example. FIGS. 12A to 12C illustrate the state before the spacer 21*b* is biased by the biasing device, and FIGS. 12D to 12F illustrate the state after the spacer 21*b* is biased by the biasing device in the direction of the arrow in FIGS. 12D and 12F.

The optical writing head positioning mechanism 20 of the present embodiment example is different from the optical writing head positioning mechanism 20 of the above-described fourth embodiment example only in the shape of the second photoconductor contact surfaces 213*a* and 213*b* of the spacers 21*a* and 21*b*. In the following description, therefore, configurations similar to those of the above-described first to fourth embodiment examples and the related-art example and the operations and effects of the configurations will be omitted where appropriate. Further, like reference numerals designate identical components or components having similar functions, unless there is a need to distinguish the components.

In the spacers 21*a* and 21*b* of the above-described fourth embodiment example, the radius of curvature of the second photoconductor contact surfaces 213*a* and 213*b* is simply specified to be greater than the radius of curvature of the photoconductor 3.

The spacers 21*a* and 21*b* of the present embodiment example are configured such that the second photoconductor contact surfaces 213*a* and 213*b* have an infinite radius of curvature, i.e., the second photoconductor contact surfaces 213*a* and 213*b* are flat surfaces. Specifically, the second photoconductor contact surface 213*b* of the present embodiment example is configured as a flat surface, as illustrated in FIGS. 12A and 12D.

With the spacers 21*a* and 21*b* designed to have the above-described shape, the manufacturing of the spacers 21*a* and 21*b* is simplified, improving the accuracy of the spacers 21*a* and 21*b*. Accordingly, the accuracy of the distance between the optical writing head 61 and the photoconductor 3 is further improved.

A sixth embodiment example will now be described.

With reference to drawings, description will be given of a sixth embodiment example of the configuration of the optical writing head positioning mechanism 20 included in the process cartridge 2 of the printer 100 according to the present embodiment.

Figure 13A:
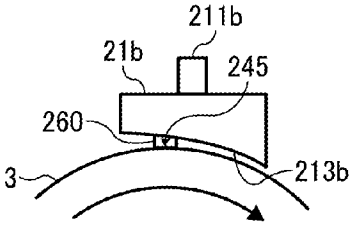
FIGS. 13A to 13F are diagrams illustrating states of contact between a first photoconductor contact surface and a second photoconductor contact surface of a spacer according to a sixth embodiment example and the photoconductor surface.
Figure 13B:
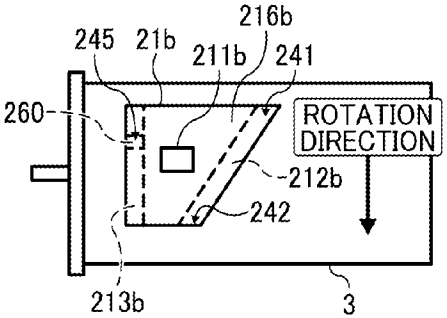
Figure 13C:
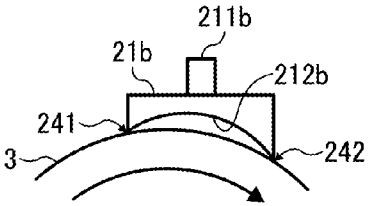
Figure 13D:
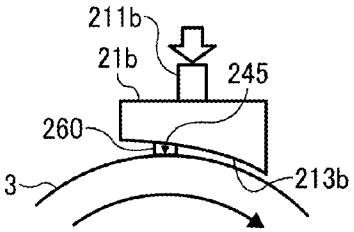
Figure 13E:
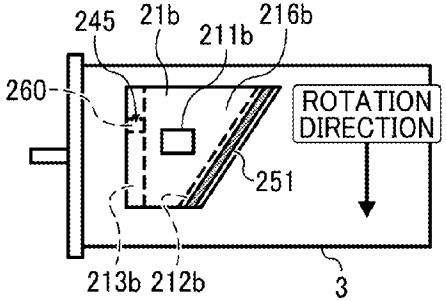
Figure 13F:
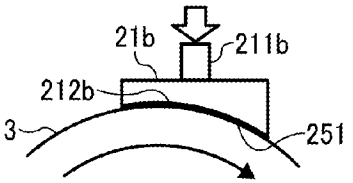

FIGS. 13A to 13F are diagrams illustrating states of contact between the surface of the photoconductor 3 and the first photoconductor contact surface 212*b* and the second photoconductor contact surface 213*b* of the spacer 21*b* according to the present embodiment example. FIGS. 13A to 13C illustrate the state before the spacer 21*b* is biased by the biasing device, and FIGS. 13D to 13F illustrate the state after the spacer 21*b* is biased by the biasing device in the direction of the arrow in FIGS. 13D and 13F.

The optical writing head positioning mechanism 20 of the present embodiment example is different from the optical writing head positioning mechanisms 20 of the above-described fourth and fifth embodiment examples only in that the shape of the second photoconductor contact surfaces 213*a* and 213*b* of the spacers 21*a* and 21*b*. In the following description, therefore, configurations similar to those of the above-described first to fifth embodiment examples and the related-art example and the operations and effects of the configurations will be omitted where appropriate. Further, like reference numerals designate identical components or components having similar functions, unless there is a need to distinguish the components.

In the spacers 21*a* and 21*b* of the above-described fourth embodiment example, the radius of curvature of the second photoconductor contact surfaces 213*a* and 213*b* is set to be greater than the radius of curvature of the photoconductor 3. Further, in the spacers 21*a* and 21*b* of the above-described fifth embodiment example, the second photoconductor contact surfaces 213*a* and 213*b* are configured as flat surfaces.

In the spacers 21*a* and 21*b* of the present embodiment example, each of the second photoconductor contact surfaces 213*a* and 213*b* is provided with a projection 260 having a bottom surface serving as the third contact location 245 that contacts the photoconductor 3.

Specifically, as illustrated in FIGS. 13A and 13D, the second photoconductor contact surface 213*b* having a radius of curvature greater than the radius of curvature of the photoconductor 3 is provided with the projection 260 having the bottom surface serving as the third contact location 245 that contacts the photoconductor 3.

With the spacers 21*a* and 21*b* designed to have the above-described shape, not the entirety of the second photoconductor contact surfaces 213*a* and 213*b* but only the bottom surface of the projection 260 requires high accuracy. Accordingly, the accuracy of the distance between the optical writing head 61 and the photoconductor 3 is further improved.

In the present embodiment described above, this disclosure is applied to the printer 100 serving as a monochrome image forming apparatus employing a direct transfer system. This disclosure, however, is not limited to such a configuration. For example, this disclosure is also applicable to a four rotation-type image forming apparatus, a direct-transfer, tandem-type image forming apparatus, and an intermediate-transfer, tandem-type image forming apparatus each capable of forming a color image.

Further, in the present embodiment described above, this disclosure is applied to the printer 100 including the drum-shaped photoconductor 3 as a latent image carrier. This disclosure, however, is not limited to such a configuration. For example, this disclosure is also applicable to an image forming apparatus including a so-called photoconductor belt, i.e., a photoconductor having the shape of an endless belt. More specifically, this disclosure is also applicable to an image forming apparatus including an optical writing head positioning mechanism having spacers contacted with a photoconductor belt tension roller (i.e., a photoconductor belt backup roller) via the photoconductor belt to position an optical writing head relative to the photoconductor belt.

The above-described embodiment and examples are illustrative, and this disclosure has effects specific to the following aspects.

According to a first aspect of this disclosure, an optical writing head positioning mechanism (e.g., the optical writing head positioning mechanism 20) includes spacers (e.g., the spacers 21*a* and 21*b*) provided between a latent image carrier (e.g., the photoconductor 3) for carrying an electrostatic latent image and an optical writing head (e.g., the optical writing head 61) for exposing the latent image carrier to light.

The spacers each include at least one carrier contact surface (e.g., the first photoconductor contact surfaces 212*a* and 212*b* and the second photoconductor contact surfaces 213*a* and 213*b*) that contacts the latent image carrier and at least one head contact surface (e.g., the head contact surfaces 211*a* and 211*b*) that contacts the optical writing head to determine the interval between the latent image carrier and the optical writing head. The latent image carrier is in contact with a cleaning member (e.g., the cleaning blade 5) that cleans a cleaning area on a surface of the latent image carrier. In at least one of the spacers (e.g., the spacer 21*a*), the at least one carrier contact surface includes a plurality of carrier contact surfaces not disposed on edges of the cleaning area (e.g., the end portions of the cleaning area having the length L3) of the cleaning member on the latent image carrier, and one of the edges of the cleaning area is located between two adjacent carrier contact surfaces of the plurality of carrier contact surfaces (e.g., the first photoconductor contact surface 212*a* and the second photoconductor contact surface 213*a*).

According to this aspect, the following effects are obtained, as described in the foregoing first to third embodiment examples. That is, according to the present aspect, the at least one of the spacers is disposed such that the one of the edges of the cleaning area is located between the two adjacent carrier contact surfaces of the plurality of carrier contact surfaces not disposed on the cleaning area ends corresponding to the edges of the cleaning area on the latent image carrier.

In the at least one of the spacers, therefore, streaks of residual toner having entered between the latent image carrier and the carrier contact surfaces of the spacer are prevented from sticking to the latent image carrier and degrading the positioning accuracy of the optical writing head relative to the latent image carrier.

Since it is thus possible to prevent the residual toner from sticking to the latent image carrier and degrading the positioning accuracy of the optical writing head relative to the latent image carrier, it is possible to increase the degree of design freedom in disposing the at least one of the spacers in a direction perpendicular to a latent image carrier moving direction (i.e., the photoconductor axial direction) compared with the configuration of the related-art example, even if the length in the direction perpendicular to the latent image carrier moving direction of the at least one of the spacers is the same between the configuration of the present aspect and the configuration of the related-art example. With the thus-increased degree of design freedom in disposing the at least one of the spacers, it is possible to position the at least one of the spacers not based on the positions of the cleaning area ends but based on the positions of the end portions of the maximum image area (e.g., the maximum image area having the length L1) of the latent image carrier.

It is therefore possible to make the length of the latent image carrier or the cleaning member in the direction perpendicular to the latent image carrier moving direction shorter than in a configuration including the spacers according to the related-art example or one of the foregoing publications.

Accordingly, it is possible to provide an optical writing head positioning mechanism capable of reducing the size of a process cartridge (e.g., the process cartridge 2) or an image forming apparatus (e.g., the printer 100) while minimizing the deterioration of the positioning accuracy of the optical writing head relative to the latent image carrier.

According to a second aspect of this disclosure, in the optical writing head positioning mechanism according to the first aspect, the plurality of carrier contact surfaces of the at least one of the spacers (e.g., the spacers 21*a* and 21*b*) are two carrier contact surfaces (e.g., the first photoconductor contact surfaces 212*a* and 212*b* and the second photoconductor contact surfaces 213*a* and 213*b*).

According to this aspect, a stable state of contact between the carrier contact surfaces of the at least one of the spacers and the surface of the latent image carrier (e.g., the photoconductor 3) is obtained, as described in the foregoing first to third embodiment examples.

According to a third aspect of this disclosure, in two of the spacers (e.g., the spacers 21*a* and 21*b*) in the optical writing head positioning mechanism according to the first or second aspect, the at least one carrier contact surface includes a plurality of carrier contact surfaces (e.g., the first photoconductor contact surfaces 212*a* and 212*b* and the second photoconductor contact surfaces 213*a* and 213*b*), with the two spacers disposed straddling the edges of the cleaning area.

According to this aspect, it is possible to make the length of the latent image carrier (e.g., the photoconductor 3) or the cleaning member (e.g., the cleaning blade 5) in the direction perpendicular to the latent image carrier moving direction or the latent image carrier rotation direction (e.g., the photoconductor axial direction) shorter than in a configuration in which the spacer disposed straddling one of the edges of the cleaning area is disposed on one side of the cleaning area, as described in the foregoing first to third embodiment examples.

According to a fourth aspect of this disclosure, in the optical writing head positioning mechanism according to one of the first to third aspects, the plurality of carrier contact surfaces (e.g., the first photoconductor contact surfaces 212*a* and 212*b* and the second photoconductor contact surfaces 213*a* and 213*b*) have different shapes.

According to this aspect, the following effects are obtained, as described in the foregoing first to third embodiment examples. For example, the width in the direction perpendicular to the latent image carrier moving direction of the carrier contact surface inside the cleaning area having the length L3 (e.g., the first photoconductor contact surfaces 212*a* and 212*b*) may be set to be narrower than the width in the direction perpendicular to the latent image carrier moving direction of the carrier contact surface outside the cleaning area having the length L3 (e.g., the second photoconductor contact surfaces 213*a* and 213*b*). Further, the carrier contact surface inside the cleaning area may be tilted. With such a configuration, it is possible to minimize accumulation of cleaning residues on the upstream side of the carrier contact surface inside the cleaning area in the latent image carrier moving direction, thereby reducing chances of the cleaning residues sticking to the latent image carrier in the maximum image area (e.g., the maximum image area having the length L1).

Further, with the length in the direction perpendicular to the latent image carrier moving direction of the carrier contact surface inside the cleaning area set to be shorter than the length in the direction perpendicular to the latent image carrier moving direction of the carrier contact surface outside the cleaning area, it is possible to make the cleaning area narrower than in a configuration including a plurality of carrier contact surfaces of the same shape. It is therefore possible to make the length in the direction perpendicular to the latent image carrier moving direction of the latent image carrier (e.g., the photoconductor 3) or the cleaning member (e.g., the cleaning blade 5) shorter than in the configuration including a plurality of carrier contact surfaces of the same shape.

According to a fifth aspect of this disclosure, in the optical writing head positioning mechanism according to the fourth aspect, among the plurality of carrier contact surfaces (e.g., the first photoconductor contact surfaces 212*a* and 212*b* and the second photoconductor contact surfaces 213*a* and 213*b*), the carrier contact surface closest to a center of the latent image carrier (e.g., the photoconductor 3) in, for example, the photoconductor axial direction perpendicular to the latent image carrier moving direction or the latent image carrier rotation direction (e.g., the first photoconductor contact surfaces 212*a* and 212*b*) is tilted relative to the moving direction of the latent image carrier.

According to this aspect, the following effects are obtained, as described in the foregoing second and third embodiment examples. That is, it is possible to make cleaning residues inside the cleaning area (e.g., the cleaning area having the length L3) move along the tilted carrier contact surface, thereby minimizing the accumulation of the cleaning residues on the upstream side of the spacer (e.g., the spacers 21*a* and 21*b*) in the latent image carrier moving direction.

Further, with the central-side carrier contact surface tilted away from the central side from upstream to downstream in the latent image carrier moving direction, it is possible to move the cleaning residues along the tilt away from the maximum image area (e.g., the maximum image area having the length L1). With the cleaning residues thus moved away from the maximum image area, it is possible to reduce the chances of the cleaning residues sticking to the latent image carrier in the maximum image area, and thereby minimize image failures.

According to a sixth aspect of this disclosure, in the optical writing head positioning mechanism according to the fifth aspect, the carrier contact surface closest to the center of the latent image carrier (e.g., the first photoconductor contact surfaces 212*a* and 212*b*) is tilted to contact the latent image carrier (e.g., the photoconductor 3) from inside to outside a maximum image area (e.g., the maximum image area having the length L1) of the latent image carrier from upstream to downstream in the moving direction (e.g., the rotation direction) of the latent image carrier.

According to this aspect, the following effects are obtained, as described in the foregoing third embodiment example. That is, cleaning residues inside the maximum image area and upstream of the central-side carrier contact surface in the latent image carrier moving direction are moved out of the maximum image area, reducing the chances of the cleaning residues sticking to the latent image carrier in the maximum image area and minimizing image failures more effectively than in the configuration of the fifth aspect. Further, it is possible to dispose the spacer (e.g., the spacers 21*a* and 21*b*) more inside in the direction perpendicular to the latent image carrier moving direction (e.g., the photoconductor axial direction) than in the configuration of the fifth aspect, and thus to make the length of the latent image carrier in the direction perpendicular to the latent image carrier moving direction shorter than in the configuration of the fifth aspect.

Further, in the configuration of the fifth aspect, a slight amount of cleaning residues may fall into an inner area in the axial direction of the latent image carrier from upstream end portions in the latent image carrier moving direction of the central-side carrier contact surface, without being moved to the outside in the axial direction of the latent image carrier. As a result, a slight amount of cleaning residues may stick to the latent image carrier near an inner end portion in the latent image carrier axial direction of the central-side carrier contact surface.

By contrast, if the upstream end portion in the latent image carrier moving direction of the central-side carrier contact surface is disposed inside the maximum image area, as in the configuration of the present aspect, such a slight amount of cleaning residues falls into the maximum image area from the upstream end portion of the carrier contact surface.

Even if the cleaning residues thus within the maximum image area stick to the latent image carrier, the cleaning residues are scraped off when passing through the cleaning member next time owing to the grinding effect of post-transfer residual toner. Further, toner may periodically be supplied to the latent image carrier for cleaning purposes to actively remove the above-described stuck deposits.

According to a seventh aspect of this disclosure, in the optical writing head positioning mechanism according to the fifth or sixth aspect, the at least one of the spacers (e.g., the spacers 21*a* and 21*b*) including the plurality of carrier contact surfaces includes ribs, and the carrier contact surface closest to the center of the latent image carrier (e.g., the first photoconductor contact surfaces 212*a* and 212*b*) forms a tip of one of the ribs.

According to this aspect, the following effects are obtained, as described in the foregoing second and third embodiment examples. That is, with the tilted carrier contact surface forming the tip of one of the ribs, the carrier contact surface easily elastically deforms to fill a gap between the latent image carrier (e.g., the photoconductor 3) and the carrier contact surface, thereby minimizing slip-through of cleaning residues.

According to an eighth aspect of this disclosure, in the optical writing head positioning mechanism according to one of the first to seventh aspects, the plurality of carrier contact surfaces are two carrier contact surfaces disposed straddling one of the edges of the cleaning area. One of the two carrier contact surfaces closest to the center of the latent image carrier in the direction perpendicular to the moving direction of the latent image carrier (e.g., the first photoconductor contact surfaces 212*a* and 212*b*) has a radius of curvature smaller than the radius of curvature of the latent image carrier, and the other one of the two carrier contact surfaces (e.g., the second photoconductor contact surfaces 213*a* and 213*b*) has a radius of curvature greater than the radius of curvature of the latent image carrier.

According to this aspect, when a biasing device biases the spacer against the latent image carrier, the central-side carrier contact surface of the spacer elastically deforms to come into surface-contact with a portion of the latent image carrier facing the carrier contact surface in, for example, the first contact area 251, while the other carrier contact surface slightly elastically deforms to come into substantially point-contact with a portion of the latent image carrier facing the carrier contact surface in a small area such as the third contact location 245, as described in the foregoing fourth to sixth embodiment examples.

As described above, the central-side carrier contact surface and the latent image carrier come into close surface-contact with each other, further minimizing the entry of cleaning residues into between the central-side carrier contact surface and the latent image carrier.

In addition, the spacer contacts the latent image carrier with the central-side carrier contact surface surface-contacted with the latent image carrier and the other carrier contact surface substantially point-contacted with the latent image carrier, thereby stabilizing the position and posture of the spacer biased when positioning the optical writing head (e.g., the optical writing head 61). It is therefore possible to improve the accuracy of the distance between the optical writing head and the latent image carrier.

According to a ninth aspect of this disclosure, in the optical writing head positioning mechanism according to the eighth aspect, the other one of the two carrier contact surfaces (e.g., the second photoconductor contact surfaces 213*a* and 213*b*) is a flat surface.

According to this aspect, the following effects are obtained, as described in the foregoing fifth embodiment example. That is, with the other one of the two carrier contact surfaces of the spacer (e.g., the spacers 21*a* and 21*b*) formed not in a curved surface but in a flat surface, the manufacturing of the spacer is simplified, improving the accuracy of the spacer. Accordingly, it is possible to further improve the accuracy of the distance between the optical writing head (e.g., the optical writing head 61) and the latent image carrier (e.g., the photoconductor 3).

According to a tenth aspect of this disclosure, in the optical writing head positioning mechanism according to the eighth or ninth aspect, the other one of the two carrier contact surfaces (e.g., the second photoconductor contact surfaces 213*a* and 213*b*) includes a projection (e.g., the projection 261) at which the other one of the two carrier contact surfaces contacts the latent image carrier (e.g., the photoconductor 3).

According to this aspect, the following effects are obtained, as described in the foregoing sixth embodiment example. That is, with the other one of the two carrier contact surfaces of the spacer (e.g., the spacers 21*a* and 21*b*) including the projection having a bottom surface that contacts the latent image carrier, the accuracy of the spacer is required not in the entirety of the carrier contact surface but only in the bottom surface of the projection. Accordingly, the accuracy of the distance between the optical writing head (e.g., the optical writing head 61) and the latent image carrier is further improved.

According to an eleventh aspect of this disclosure, a process cartridge (e.g., the process cartridge 2) includes a latent image carrier (e.g., the photoconductor 3) and the optical writing head positioning mechanism (e.g., the optical writing head positioning mechanism 20) according to one of the first to tenth aspects. The latent image carrier is to be exposed to light by an optical writing head (e.g., the optical writing head 61) to form an electrostatic latent image on the latent image carrier. The optical writing head positioning mechanism positions the optical writing head relative to the latent image carrier.

According to this aspect, a process cartridge capable of providing effects similar to those of the optical writing head positioning mechanism according to one of the first to tenth aspects is provided, as described in the foregoing first to sixth embodiment examples.

According to a twelfth aspect of this disclosure, an image forming apparatus (e.g., the printer 100) includes an optical writing head (e.g., the optical writing head 61), a latent image carrier (e.g., the photoconductor 3) to be exposed to light by the optical writing head to form an electrostatic latent image on the latent image carrier, and the optical writing head positioning mechanism (e.g., the optical writing head positioning mechanism 20) according to one of the first to tenth aspects or the optical writing head positioning mechanism included in the process cartridge according to the eleventh aspect to position the optical writing head relative to the latent image carrier.

According to this aspect, an image forming apparatus capable of providing effects similar to those of the optical writing head positioning mechanism according to one of the first to tenth aspects or the process cartridge according to the eleventh aspect is provided, as described in the foregoing first to sixth embodiment examples.

The above-described embodiments are illustrative and do not limit this disclosure. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of this disclosure may be practiced otherwise than as specifically described herein.

What is claimed is:

1. An optical writing head positioning mechanism comprising:

spacers provided between a latent image carrier for carrying an electrostatic latent image and an optical writing head for exposing the latent image carrier to light, the spacers each including at least one carrier contact surface that contacts the latent image carrier and at least one head contact surface that contacts the optical writing head to determine an interval between the latent image carrier and the optical writing head, wherein the latent image carrier is in contact with a cleaning member that cleans a cleaning area on a surface of the latent image carrier, and wherein, in at least one of the spacers, the at least one carrier contact surface includes a plurality of carrier contact surfaces not disposed on edges of the cleaning area on the latent image carrier cleaned by the cleaning member, and one of the edges of the cleaning area is located between two adjacent carrier contact surfaces of the plurality of carrier contact surfaces.

2. The optical writing head positioning mechanism according to claim 1, wherein the plurality of carrier contact surfaces of the at least one of the spacers are two carrier contact surfaces.

3. The optical writing head positioning mechanism according to claim 1, wherein, in two of the spacers, the at least one carrier contact surface includes a plurality of carrier contact surfaces, with the two spacers disposed straddling the edges of the cleaning area.

4. The optical writing head positioning mechanism according to claim 1, wherein the plurality of carrier contact surfaces have different shapes.

5. The optical writing head positioning mechanism according to claim 4, wherein one of the plurality of carrier contact surfaces closest to a center of the latent image carrier in a direction perpendicular to a moving direction of the latent image carrier is tilted relative to the moving direction of the latent image carrier.

6. The optical writing head positioning mechanism according to claim 5, wherein the carrier contact surface closest to the center of the latent image carrier is tilted to contact the latent image carrier from inside to outside a maximum image area of the latent image carrier from upstream to downstream in the moving direction of the latent image carrier.

7. The optical writing head positioning mechanism according to claim 5, wherein the at least one of the spacers including the plurality of carrier contact surfaces includes ribs, and the carrier contact surface closest to the center of the latent image carrier forms a tip of one of the ribs.

8. The optical writing head positioning mechanism according to claim 1, wherein the plurality of carrier contact surfaces are two carrier contact surfaces disposed straddling one of the edges of the cleaning area, and wherein one of the two carrier contact surfaces closest to a center of the latent image carrier in a direction perpendicular to a moving direction of the latent image carrier has a radius of curvature smaller than a radius of curvature of the latent image carrier, and the other one of the two carrier contact surfaces has a radius of curvature greater than the radius of curvature of the latent image carrier.

9. The optical writing head positioning mechanism according to claim 8, wherein the other one of the two carrier contact surfaces is a flat surface.

10. The optical writing head positioning mechanism according to claim 8, wherein the other one of the two carrier contact surfaces includes a projection at which the other one of the two carrier contact surfaces contacts the latent image carrier.

11. A process cartridge comprising:

a latent image carrier to be exposed to light by an optical writing head to form an electrostatic latent image on the latent image carrier; and an optical writing head positioning mechanism to position the optical writing head relative to the latent image carrier, wherein the optical writing head positioning mechanism comprises spacers provided between the latent image carrier and the optical writing head, the spacers each including at least one carrier contact surface that contacts the latent image carrier and at least one head contact surface that contacts the optical writing head to determine an interval between the latent image carrier and the optical writing head, wherein the latent image carrier is in contact with a cleaning member that cleans a cleaning area on a surface of the latent image carrier, and wherein, in at least one of the spacers, the at least one carrier contact surface includes a plurality of carrier contact surfaces not disposed on edges of the cleaning area on the latent image carrier cleaned by the cleaning member, and one of the edges of the cleaning area is located between two adjacent carrier contact surfaces of the plurality of carrier contact surfaces.

12. An image forming apparatus comprising:

an optical writing head;

a latent image carrier to be exposed to light by the optical writing head to form an electrostatic latent image on the latent image carrier; and an optical writing head positioning mechanism to position the optical writing head relative to the latent image carrier, wherein the optical writing head positioning mechanism comprises spacers provided between the latent image carrier and the optical writing head, the spacers each including at least one carrier contact surface that contacts the latent image carrier and at least one head contact surface that contacts the optical writing head to determine an interval between the latent image carrier and the optical writing head, wherein the latent image carrier is in contact with a cleaning member that cleans a cleaning area on a surface of the latent image carrier, and wherein, in at least one of the spacers, the at least one carrier contact surface includes a plurality of carrier contact surfaces not disposed on edges of the cleaning area on the latent image carrier cleaned by the cleaning member, and one of the edges of the cleaning area is located between two adjacent carrier contact surfaces of the plurality of carrier contact surfaces.

* * * * *